US008388107B2

(12) United States Patent
Gómez et al.

(10) Patent No.: US 8,388,107 B2
(45) Date of Patent: Mar. 5, 2013

(54) LATCH FOR A LIQUID DISPENSER

(75) Inventors: Arturo Garcia Gómez, Sabadell Barcelona (ES); Eduardo Martin, Sabadell (ES); Pau Martin, Barcelona (ES); Ralph Stathem, Lebanon, OR (US); Raymond Ehlers, Corvallis, OR (US); Daniel W Petersen, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 88 days.

(21) Appl. No.: 13/092,389

(22) Filed: Apr. 22, 2011

(65) Prior Publication Data

US 2012/0268535 A1 Oct. 25, 2012

(51) Int. Cl.
*B41J 2/175* (2006.01)

(52) U.S. Cl. ..... 347/49; 347/50; 347/85

(58) Field of Classification Search ..... 347/84, 347/85, 86, 49, 50, 37, 39
See application file for complete search history.

(56) References Cited

U.S. PATENT DOCUMENTS

| | | | | |
|---|---|---|---|---|
| 5,379,056 | A | 1/1995 | Walter et al. | |
| 5,751,322 | A | 5/1998 | Miller et al. | |
| 5,852,459 | A | 12/1998 | Pawlowski et al. | |
| 5,971,529 | A | 10/1999 | Pawlowski et al. | |
| 6,033,064 | A | 3/2000 | Pawlowski et al. | |
| 6,137,513 | A | 10/2000 | Pawlowski et al. | |
| 6,190,007 | B1 * | 2/2001 | Taylor et al. | 347/84 |
| 6,367,918 | B1 * | 4/2002 | Heiles et al. | 347/86 |
| 6,481,829 | B1 * | 11/2002 | Bailey et al. | 347/49 |
| 6,520,625 | B1 * | 2/2003 | Kawakami | 347/49 |
| 6,851,795 | B2 * | 2/2005 | Watanabe et al. | 347/50 |
| 7,648,222 | B2 | 1/2010 | Morgan et al. | |
| 2002/0118262 | A1 * | 8/2002 | Seino et al. | 347/86 |
| 2003/0025763 | A1 * | 2/2003 | Sturgeon et al. | 347/49 |
| 2008/0180495 | A1 | 7/2008 | Gonzales | |
| 2010/0238235 | A1 | 9/2010 | Long et al. | |

FOREIGN PATENT DOCUMENTS

| | | |
|---|---|---|
| WO | WO0154911 A1 | 8/2001 |

* cited by examiner

*Primary Examiner* — Matthew Luu
*Assistant Examiner* — Lily Kemathe
(74) *Attorney, Agent, or Firm* — Steven R. Ormiston

(57) ABSTRACT

In one embodiment, a latch for a liquid dispensing component includes: a first part for holding a liquid dispensing component in a seated position in a holder, the first part movable between an open position in which the component may be installed in or removed from the holder and a closed position in which the component is held in the seated position in the holder; and a second part for connecting the component to a liquid supply port, the second part movable, while the first part is in the closed position, between a disconnected position in which the component is not connected to the liquid supply port and a connected position in which the component is connected to the liquid supply port.

13 Claims, 22 Drawing Sheets

LATCH FOR A LIQUID DISPENSER

BACKGROUND

In some inkjet printers, ink is supplied to a multi-color printhead module through multiple needle-septum connections in which each needle is inserted through a corresponding septum. Each color of ink requires a separate needle-septum connection. Consequently, the force needed to simultaneously insert the needles into the septa to make multiple ink connections, or to withdraw the needles simultaneously from the septa to break the connections, increases as the number of ink colors increases—the more colors the printhead uses, the greater the force needed to make and break the ink supply connections. Unfortunately, as this force increases, so too does the risk of dislodging the printhead module from its seated, properly aligned position in the printer carriage during needle insertion and needle withdrawal. Keeping the printhead module properly aligned helps the user accurately and safely make and break the ink connections.

DRAWINGS

FIG. 1 is a block diagram illustrating one example of an inkjet printer in which embodiments of the new latching solution may be implemented.

FIGS. 2-4 are perspective views illustrating one embodiment of a new latch for securing a printhead module in a printer carriage, for example in a printer such as that shown in FIG. 1. In the embodiment of FIGS. 2-4, the hold down and engagement functions are achieved using separate actuators in a dual latching operation. The latch is fully open in FIGS. 2 and 3. The latch is fully closed in FIG. 4.

Figures 11, 11A, 11B:
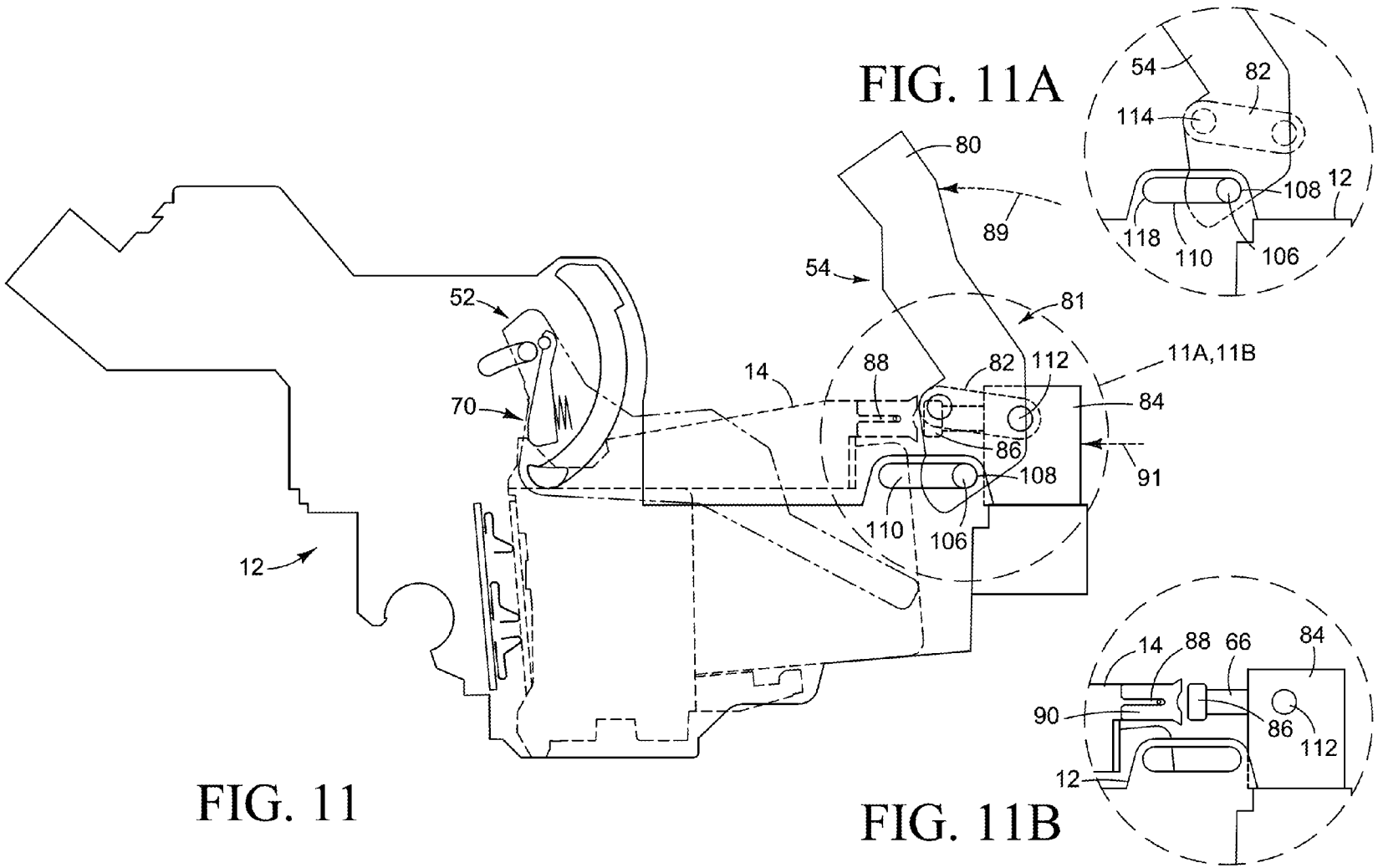
Figure 12A:
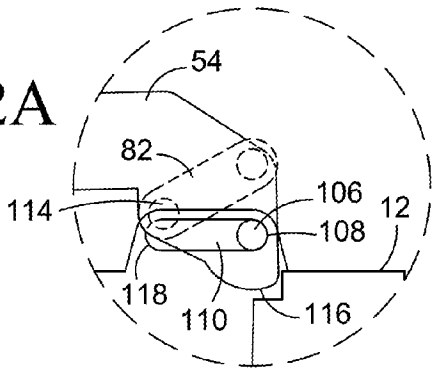
Figure 12B:
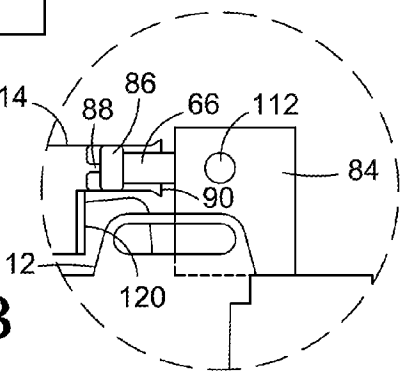
Figure 12:
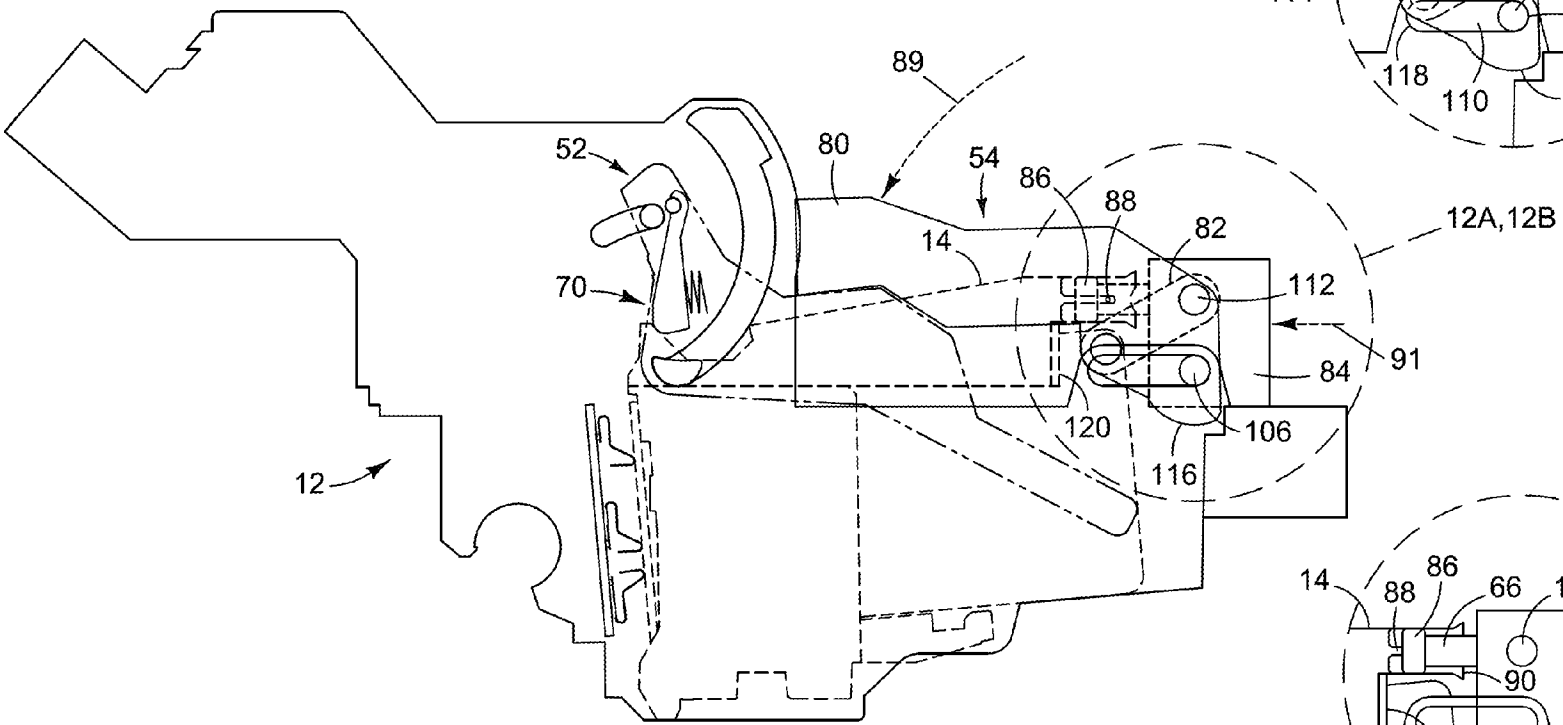
Figures 13, 13A, 13B:
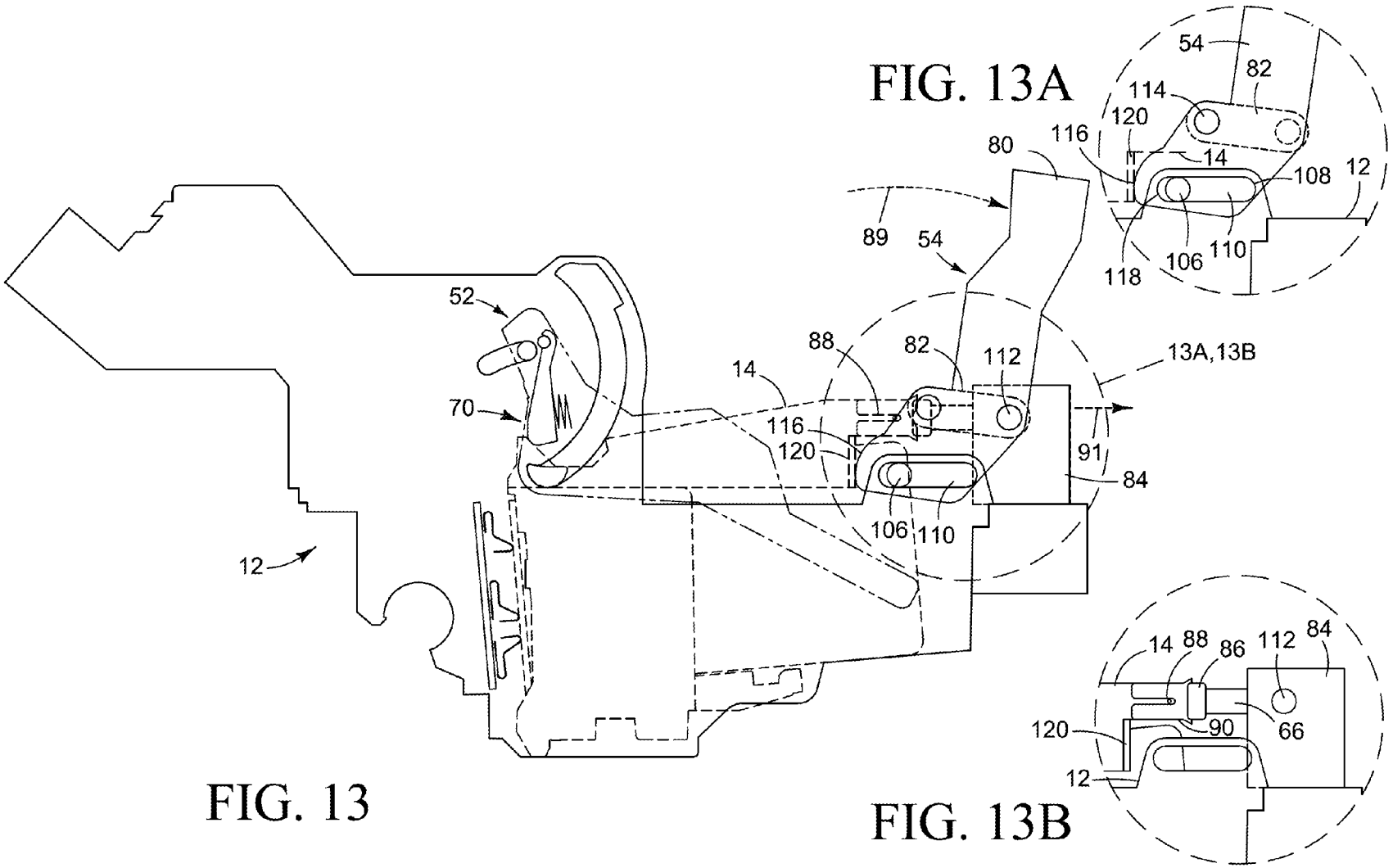

FIGS. 11A, 11B, 12A, 12B, and 13A, 13B are detail views taken from FIGS. 11, 12 and 13, respectively. The ink supply ports are omitted in FIGS. 11A, 12A, and 13A to better illustrate some of the latch parts. Some of the latch parts are omitted in FIGS. 11B, 12B, and 13B to better illustrate movement of the ink supply ports.

Figure 14:
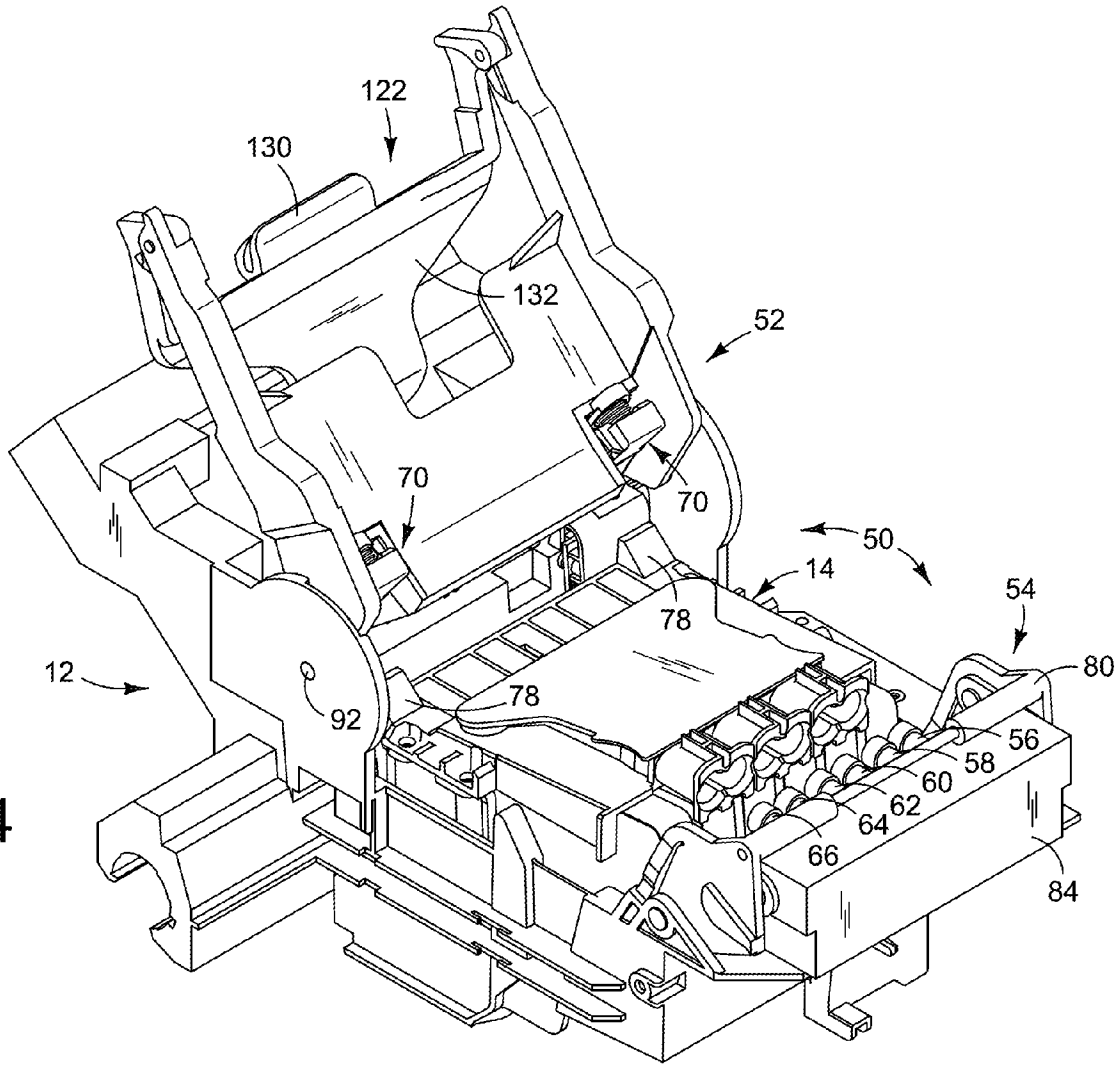
Figure 15:
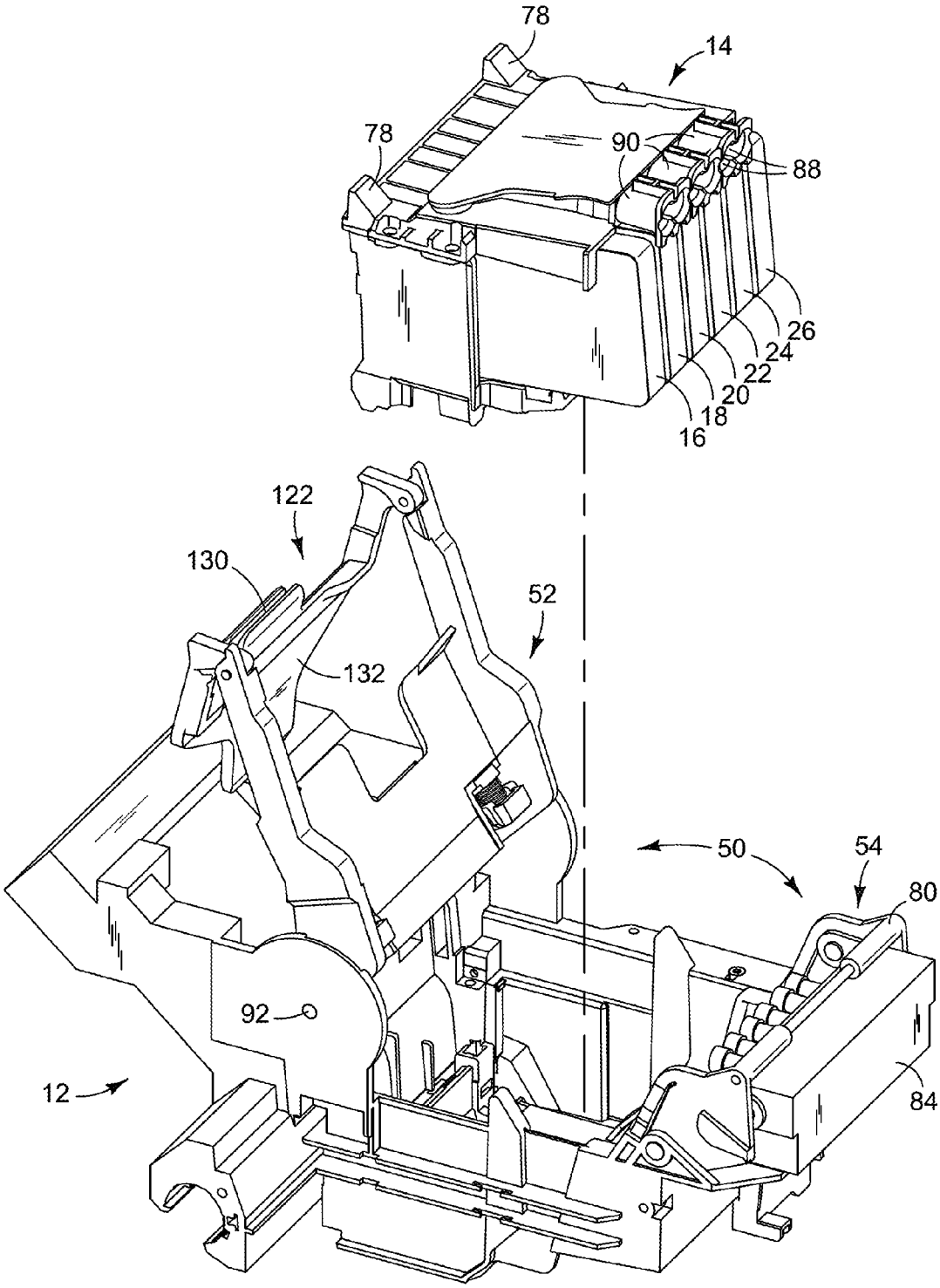
Figure 16:
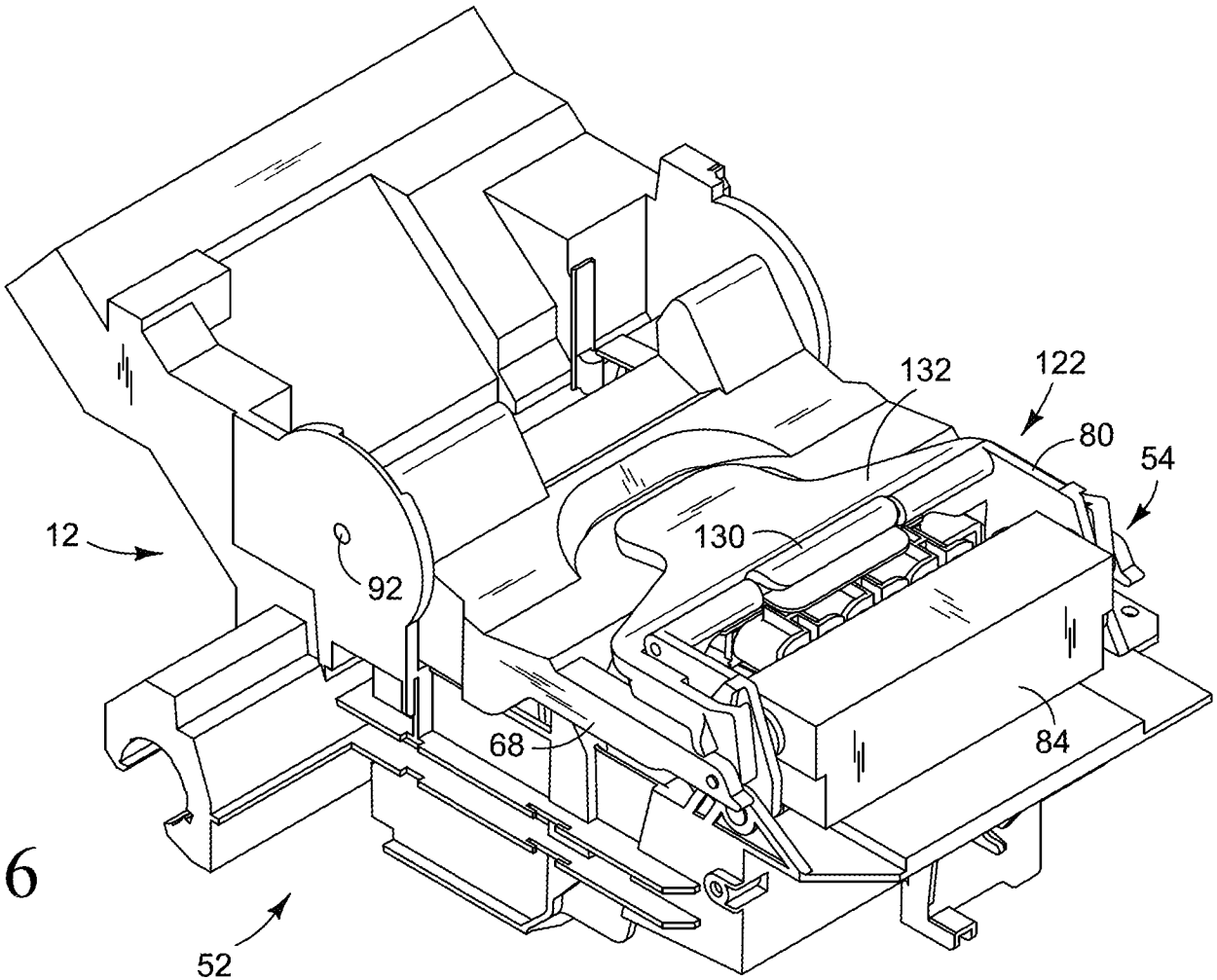

FIGS. 14-16 are perspective views illustrating another embodiment of a new latch for securing a printhead module in a printer carriage. In the embodiment of FIGS. 14-16, the hold down and engagement functions are achieved using one actuator in a single latching operation. The latch is fully open in FIGS. 14 and 15. The latch is fully closed in FIG. 16.

Figure 17:
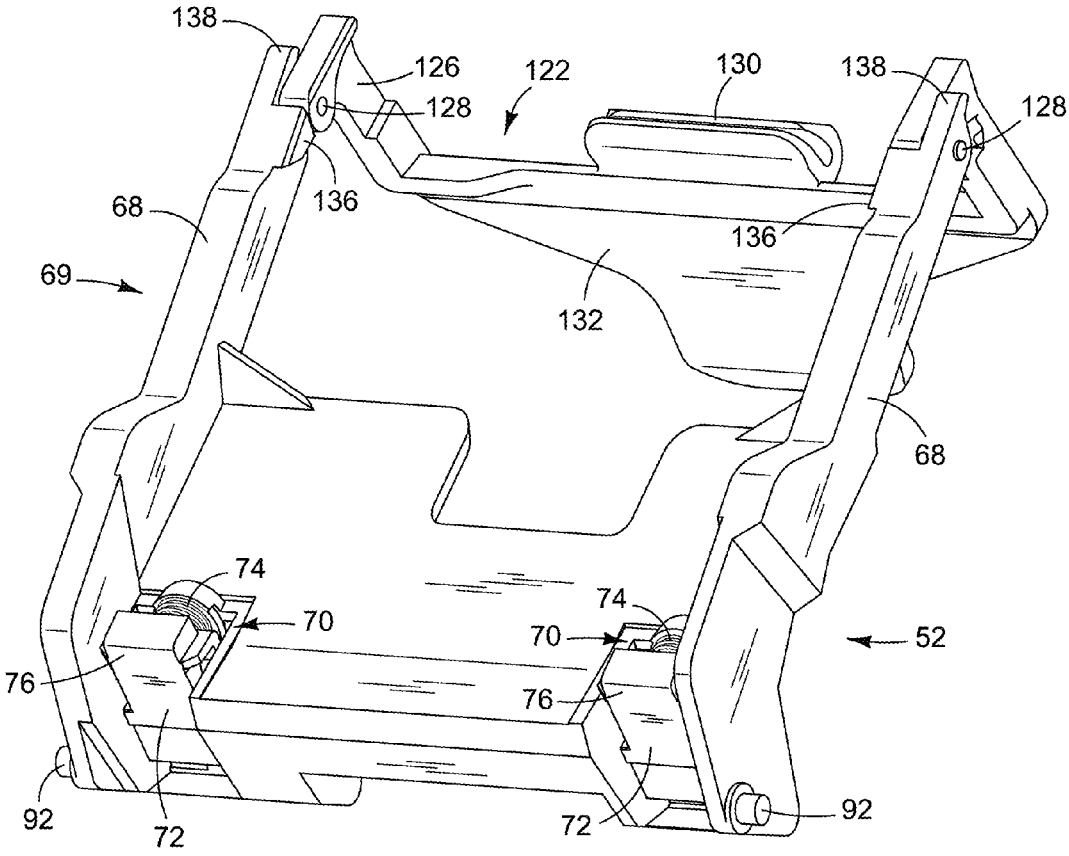

FIG. 17 is a detail view illustrating one part of the latch of FIGS. 14-16 for holding the printhead module.

Figure 18:
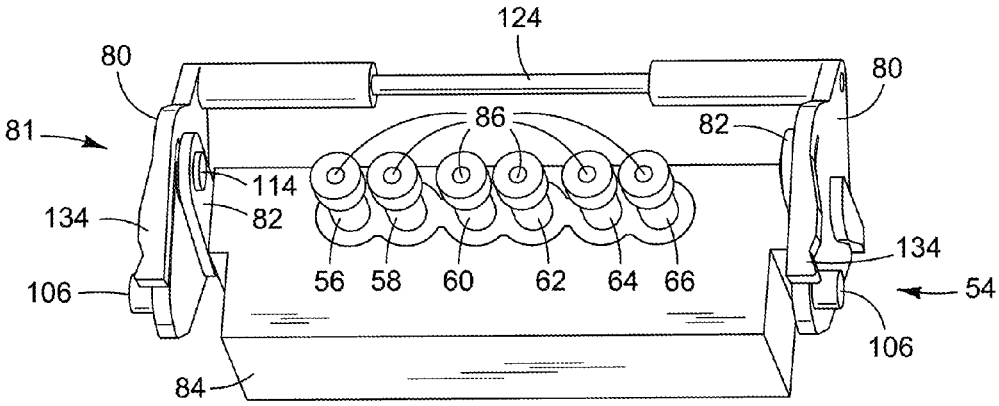

FIG. 18 is a detail view illustrating another part of the latch of FIGS. 14-16 for connecting the ink supply ports to the printhead module.

FIGS. 19-23 are elevation views illustrating a sequence of operation for the latch of FIGS. 14-16.

Figures 22, 22A, 22B:
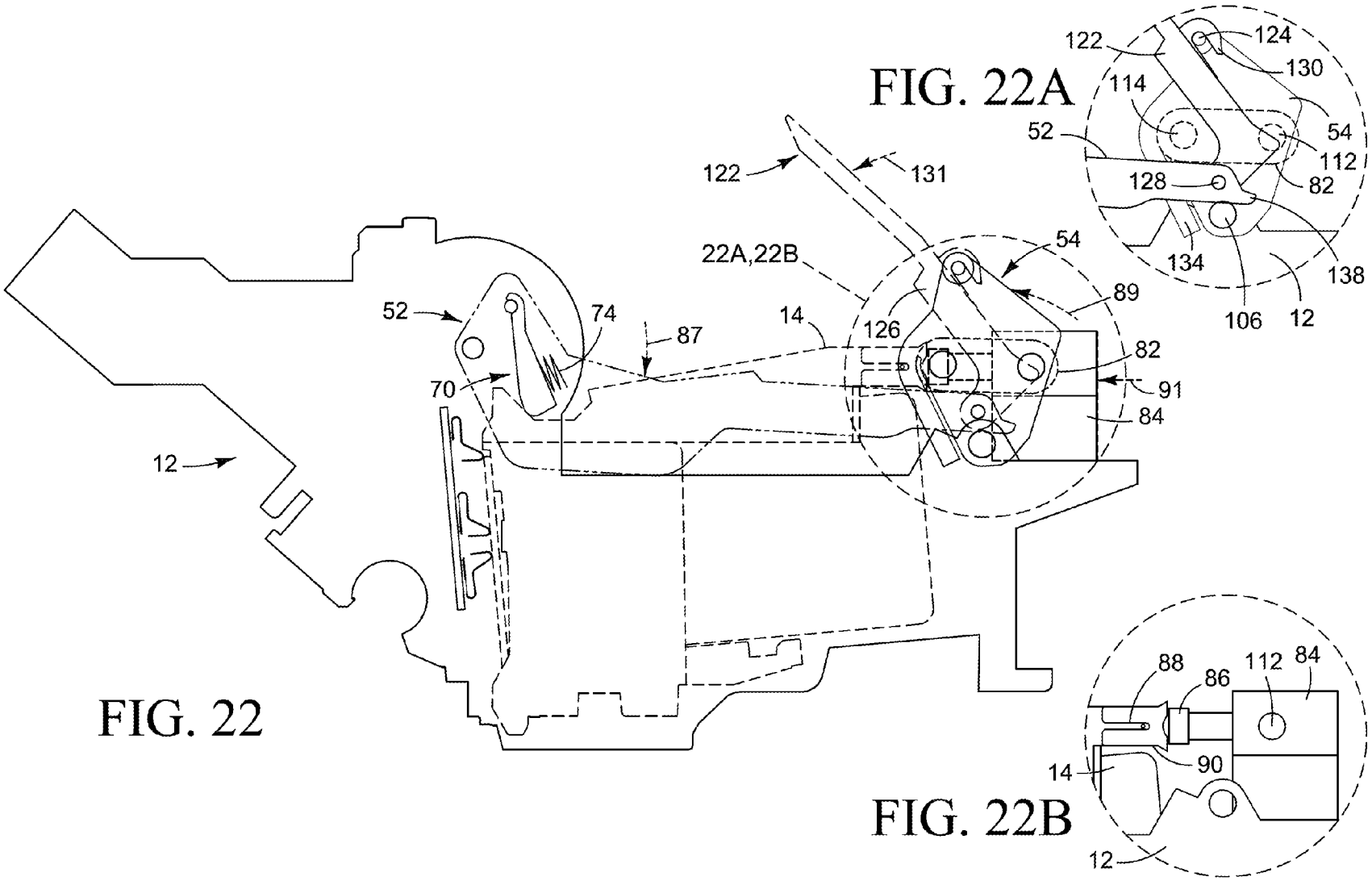
Figures 23, 23A, 23B:
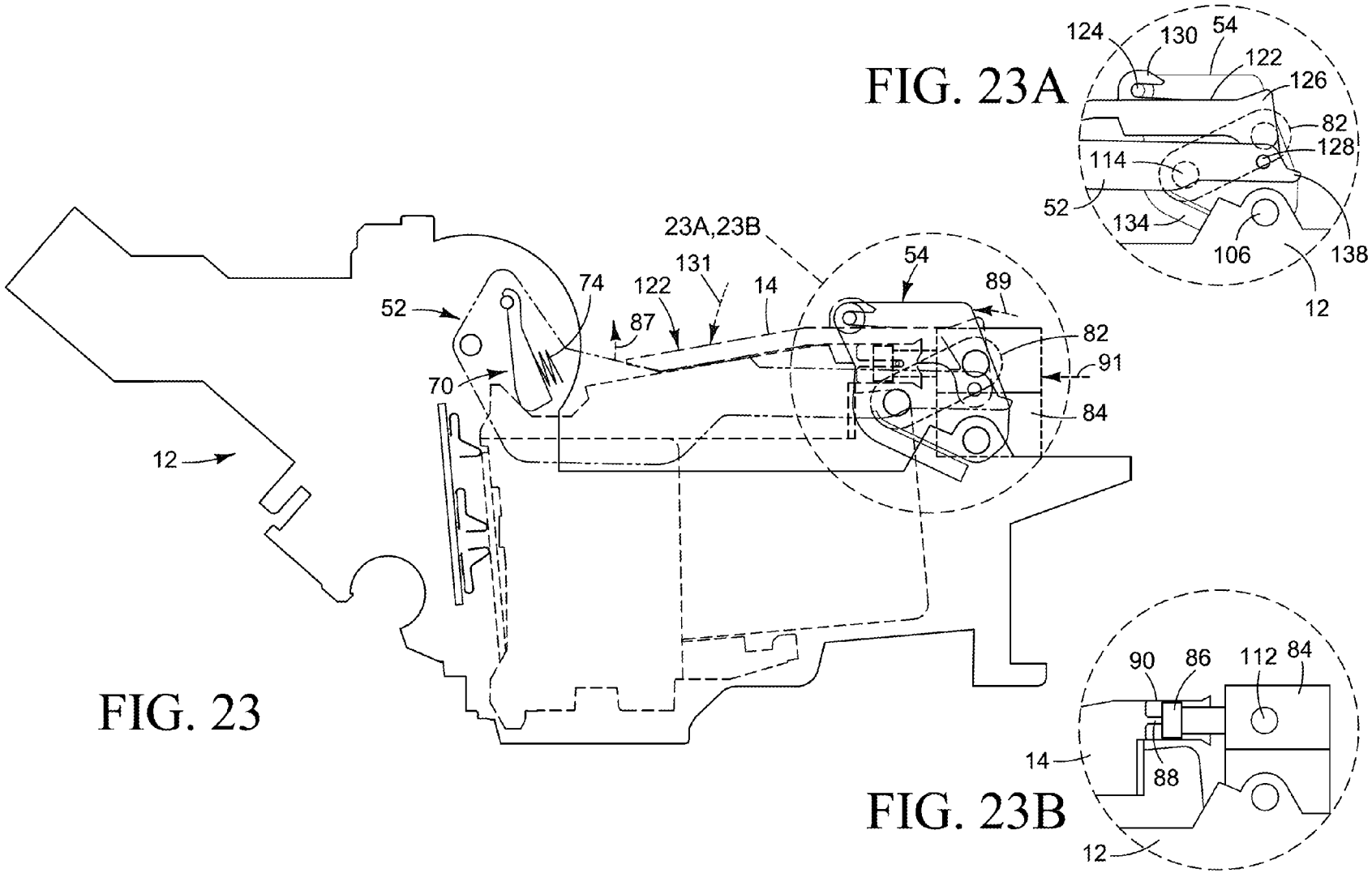

FIGS. 22A, 22B, 23A, and 23B are detail views taken from FIGS. 22 and 23, respectively. The ink supply ports are omitted in FIGS. 22A and 23A to better illustrate some of the latch parts. Some of the latch parts are omitted in FIGS. 22B and 23B to better illustrate movement of the ink supply ports.

Figure 20:
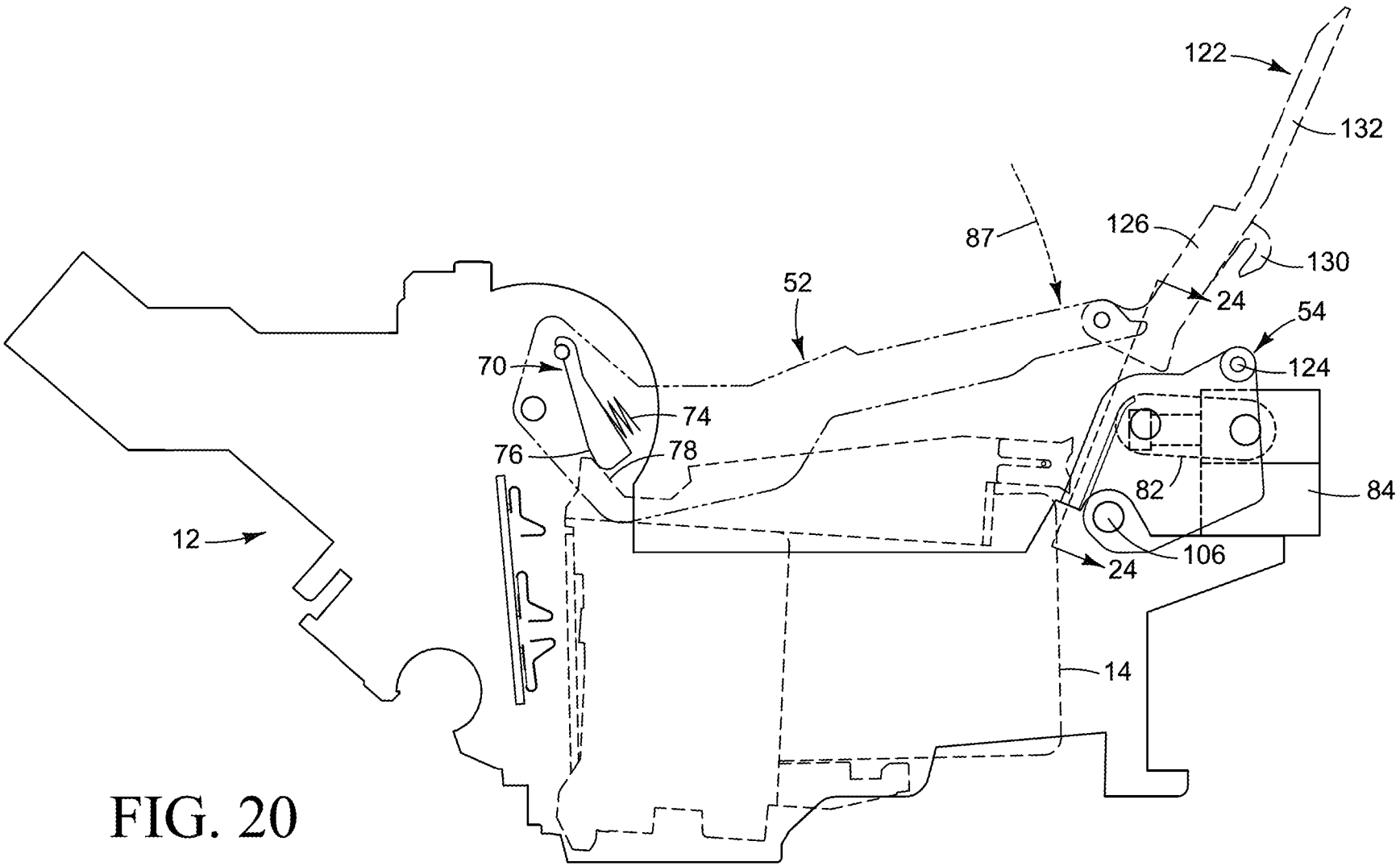
Figure 24:
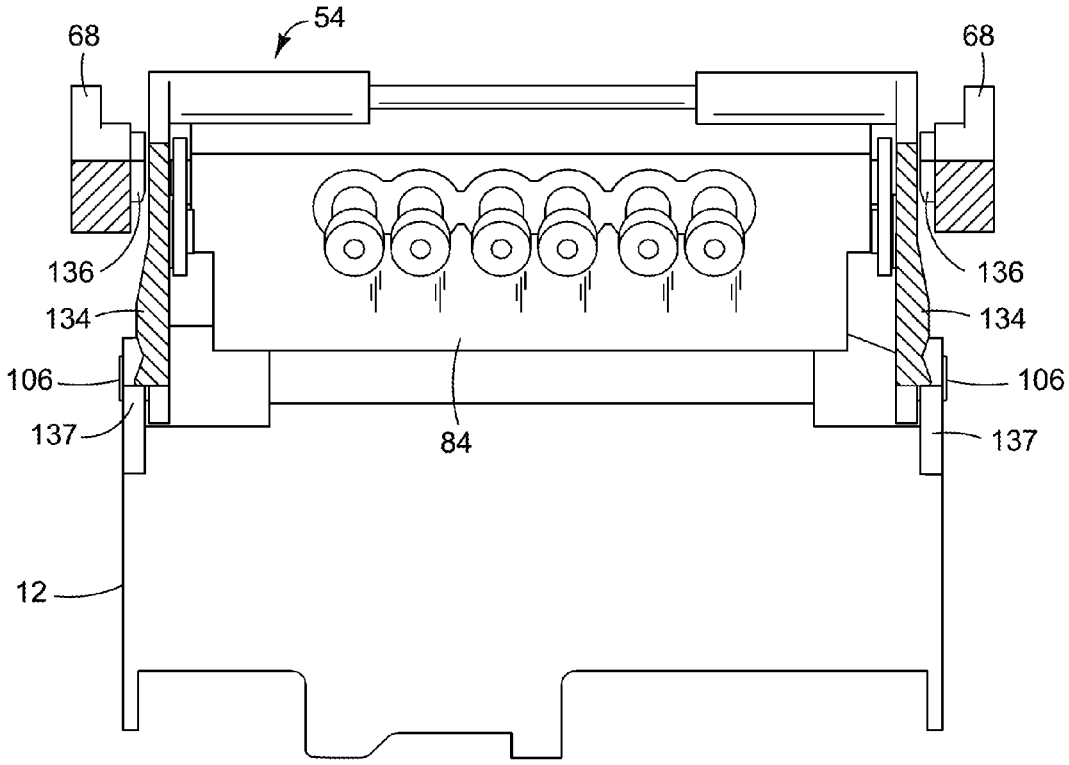

FIG. 24 is a section view taken along the line 24-24 in FIG. 20.

Figure 21:
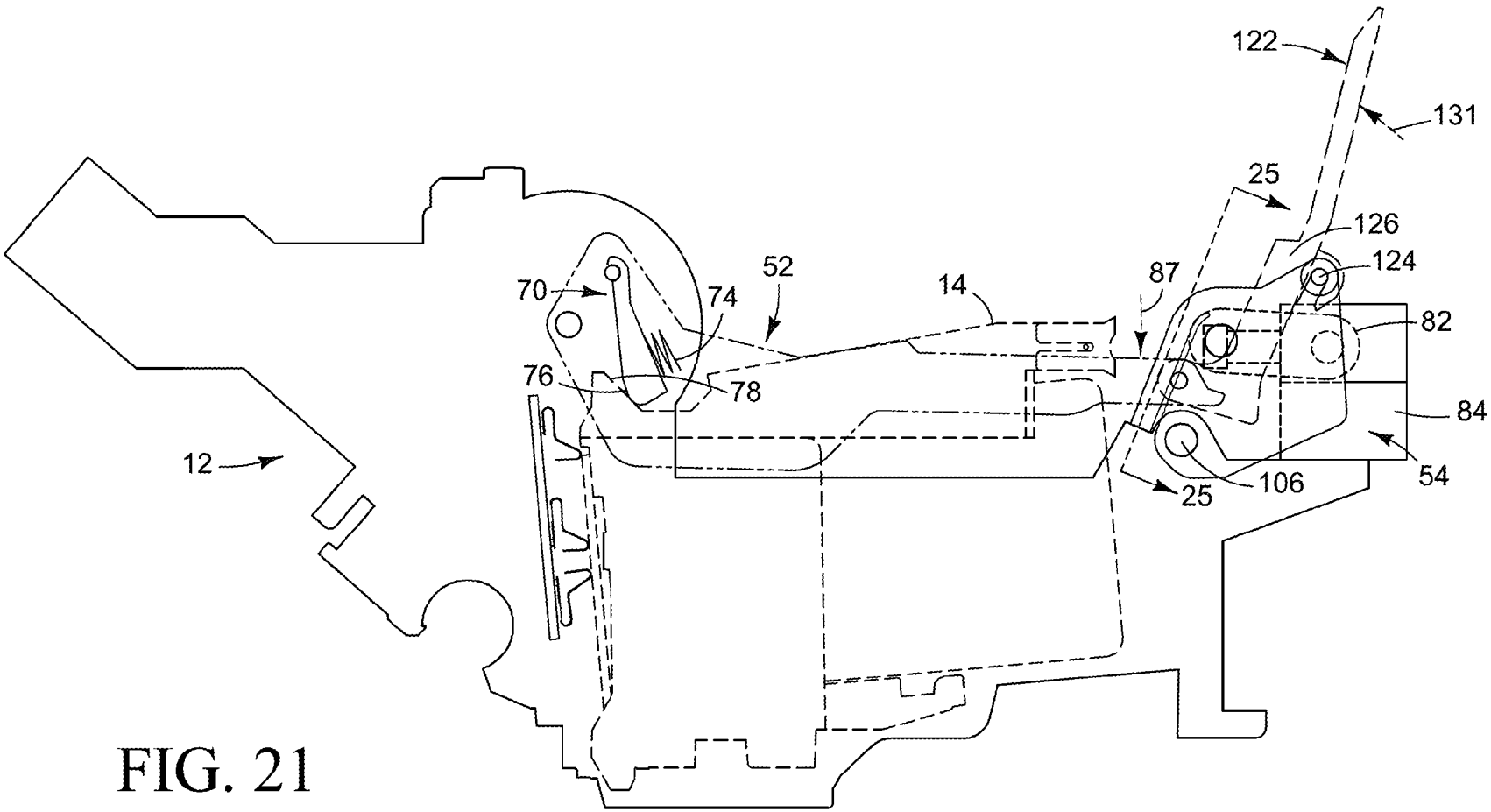
Figure 25:
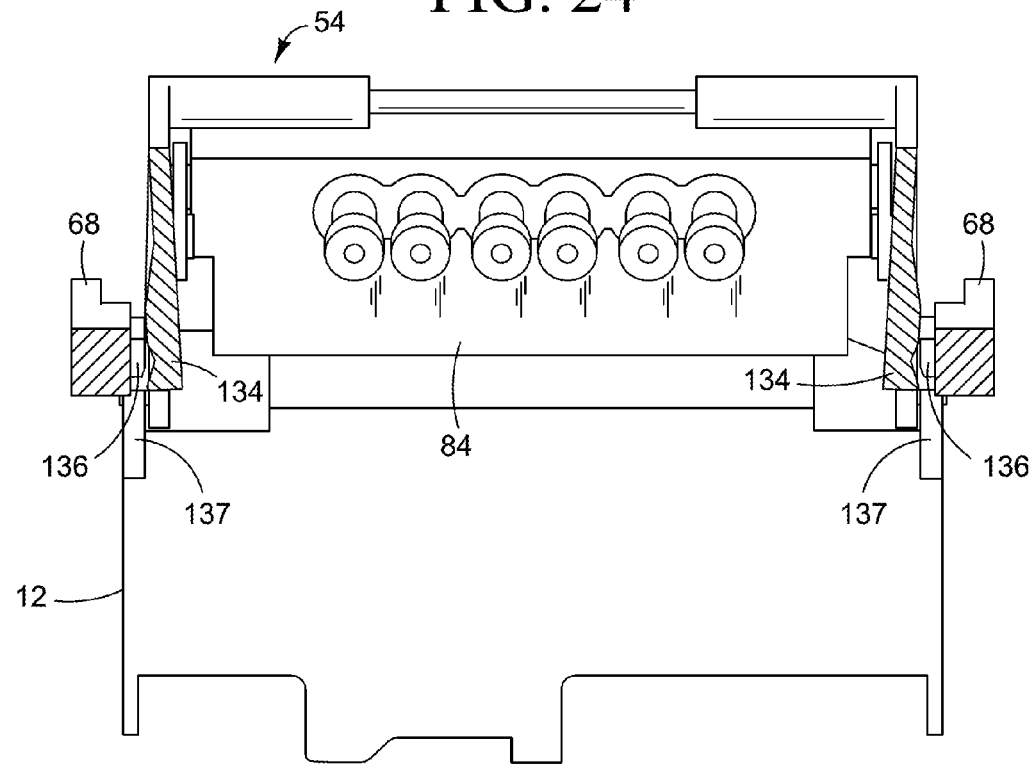

FIG. 25 is a section view taken along the line 25-25 in FIG. 21.

The same part numbers are used to designate the same or similar parts throughout the figures.

DESCRIPTION

A new latching solution has been developed to help keep the printhead module properly aligned during needle insertion and needle withdrawal, thus allowing the user to accurately and safely make and break the ink connections. In one embodiment of the new latching solution, one part of the latch secures the printhead module in the properly aligned position while a second part of the latch moves the needles and septa together to make the ink connections (and moves the needles and septa apart to break the ink connections). In one example implementation, each function is achieved using independent levers in a dual latching operation. In another example implementation, both functions are achieved using interconnected levers in a single latching operation.

Example embodiments of the invention are described below with reference to an inkjet printer in which a carriage scans a multi-color printhead module back and forth across the print media. However, embodiments are not limited to scanning inkjet printers or even inkjet printing in general. Embodiments might also be implemented in other types of inkjet printers or in other types of liquid dispensers. The embodiments shown in the figures and described below, therefore, illustrate but do not limit the invention, which is defined in the Claims following this Description.

As used in this document, "liquid" means a fluid not composed primarily of a gas or gases.

Figure 1:
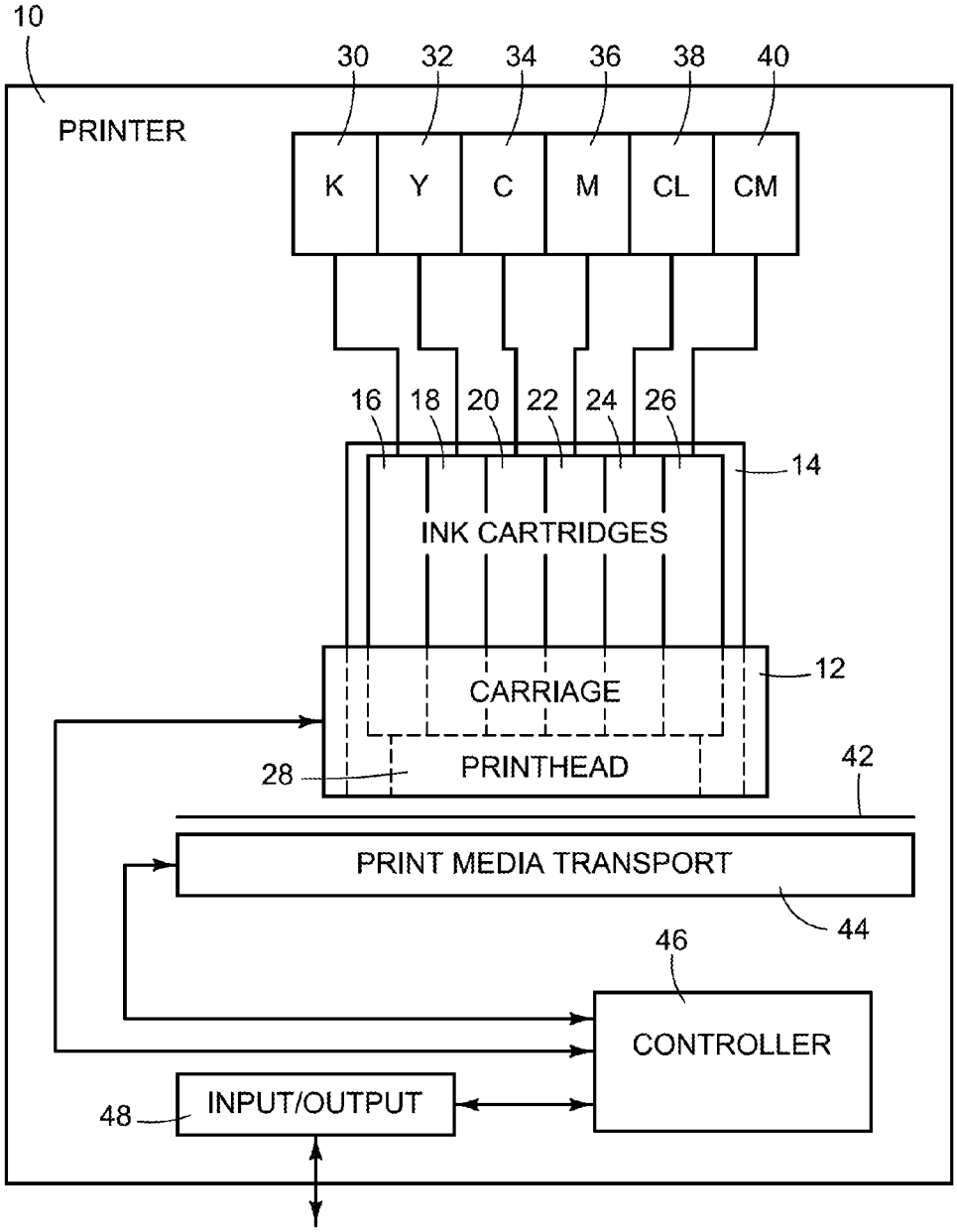

FIG. 1 is a block diagram illustrating one example of an inkjet printer 10 in which embodiments of the invention may be implemented. Referring to FIG. 1, printer 10 includes a carriage 12 carrying a printhead module 14. Printhead module 14 includes a series of ink cartridges 16, 18, 20, 22, 24, and 26 connected to a printhead 28. Ink is supplied to cartridges 16-26 from a series of ink supplies 30, 32, 34, 36, 38, and 40 located remote from carriage 12. Each ink cartridge 16-26 represents generally the operative components needed to regulate the flow of ink to printhead 28, for example, a single color of ink such as black (K), yellow (Y), cyan (C), magenta (M), light cyan (CL) and light magenta (ML). Each ink cartridge 16-26 may itself be a removable component in module 14 or a permanent component of module 14. Printhead 28 represents generally the operative components needed to expel ink from module 14 on to print media 42. For example, black ink is pumped or otherwise introduced into cartridge 16 from ink supply 30 to a pressure regulator chamber in cartridge 16. Ink flows from the regulator chamber through a filter to printhead 28, where it is ejected on to print media 42.

An inkjet printhead 28 is typically a small electromechanical assembly that contains an array of miniature thermal, piezoelectric or other devices that are energized or activated to eject small droplets of ink out of an associated array of nozzles. A typical thermal inkjet printhead, for example, includes a nozzle plate arrayed with ink ejection nozzles and firing resistors formed on an integrated circuit chip. Printhead 28 may be formed, for example, as a series of discrete printheads each serving one or more cartridges 16-26, or as a single printhead serving all of cartridges 16-26 through multiple nozzle arrays and corresponding fluid delivery channels.

A print media transport mechanism 44 advances print media 42 past carriage 12 and printhead 28. For a movable, scanning carriage 12, media transport 44 typically will advance media 42 incrementally past carriage 12, stopping as each swath is printed and then advancing media 42 for printing the next swath. An electronic controller 46 is operatively connected to carriage 12, ink cartridges 16-26, printhead 28, and media transport 44. Controller 46 communicates with external devices through an input/output device 48, including receiving print data for inkjet imaging. The presence of an input/output device 48 in FIG. 1, however, does not preclude the operation of printer 10 as a standalone unit. By coordinating the relative position of carriage 12 with media 42 and the ejection of ink drops, controller 46 produces the desired image on media 42.

Dual Latching Embodiment

Figure 2:
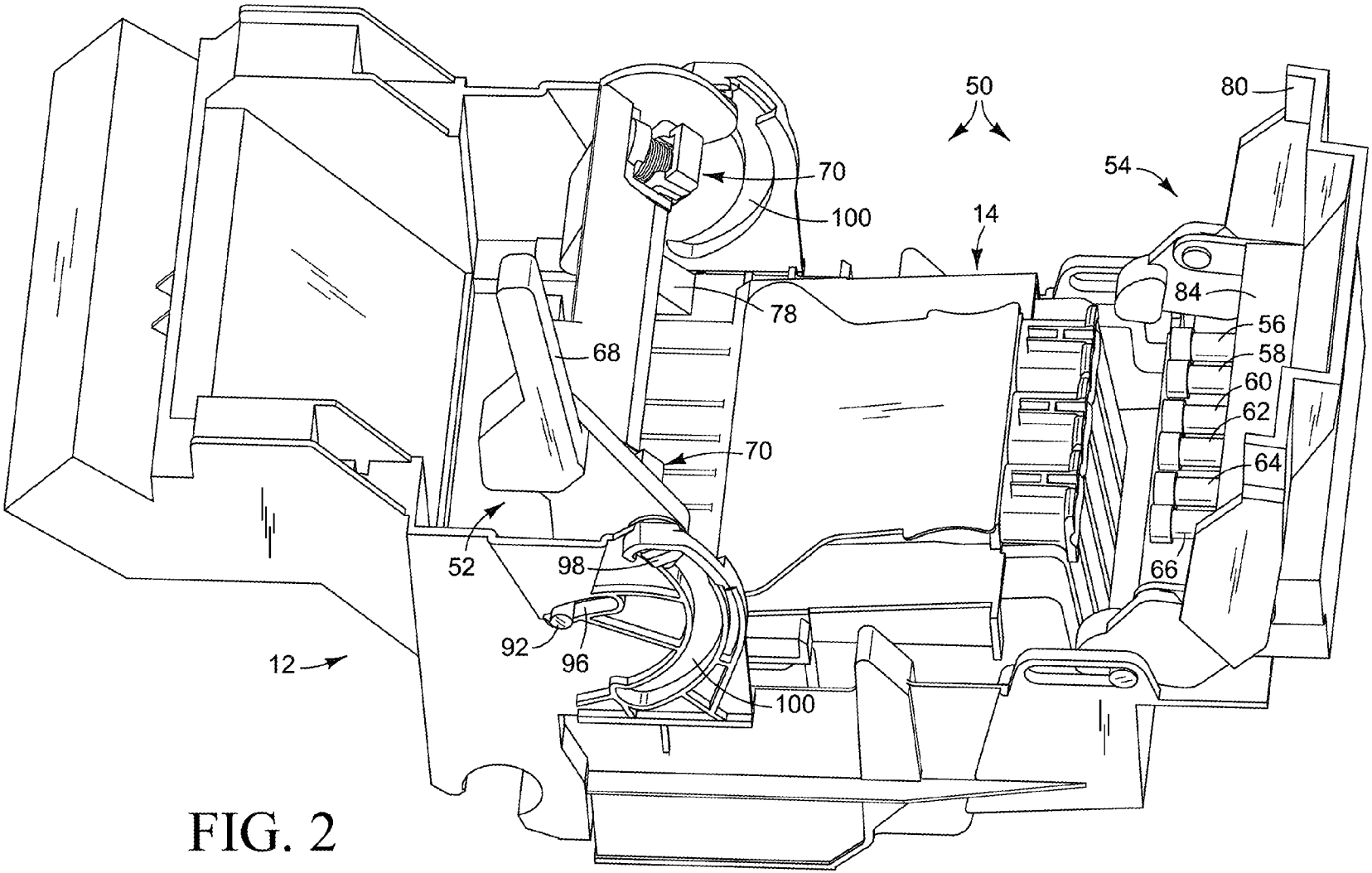
Figure 3:
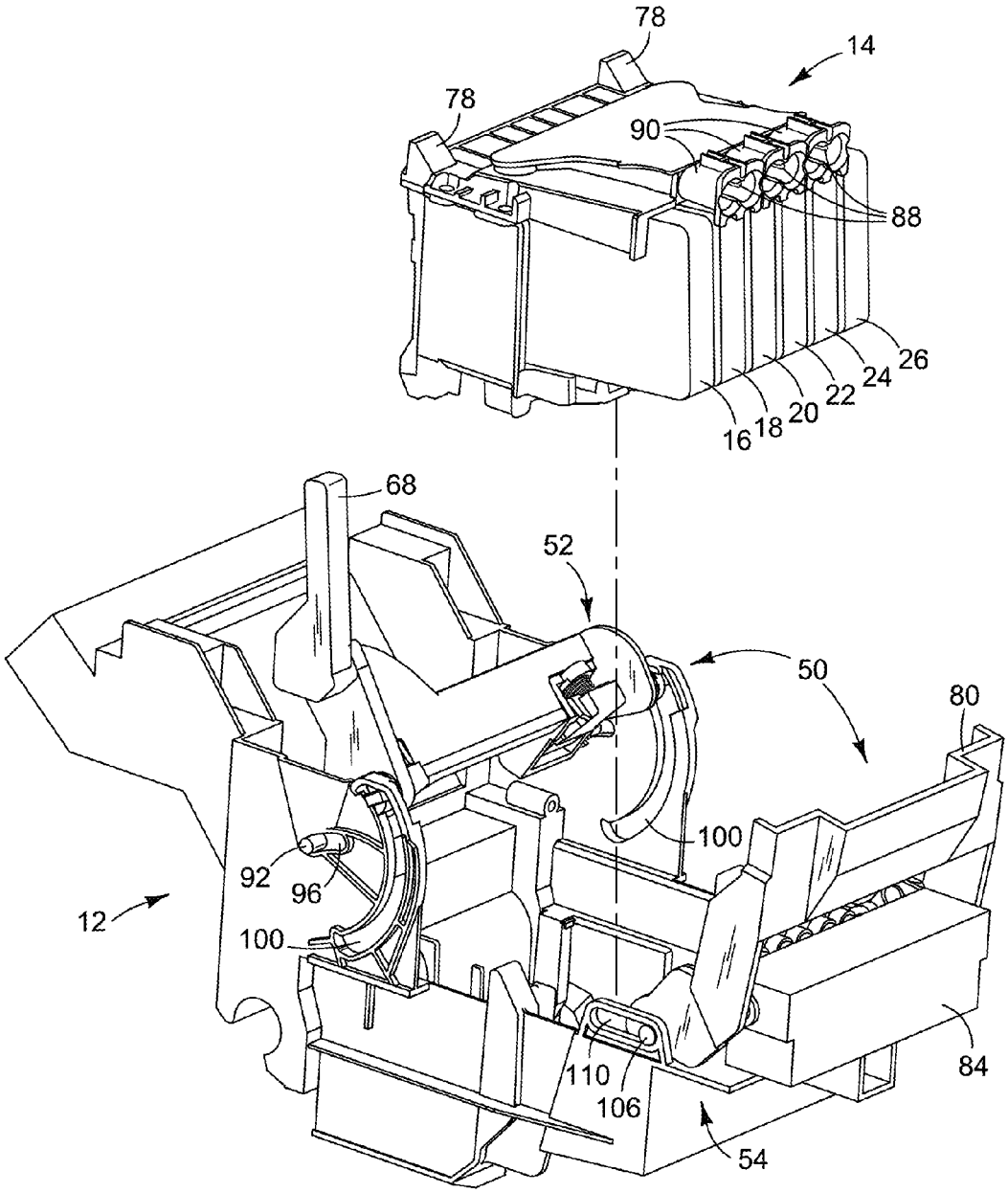
Figure 4:
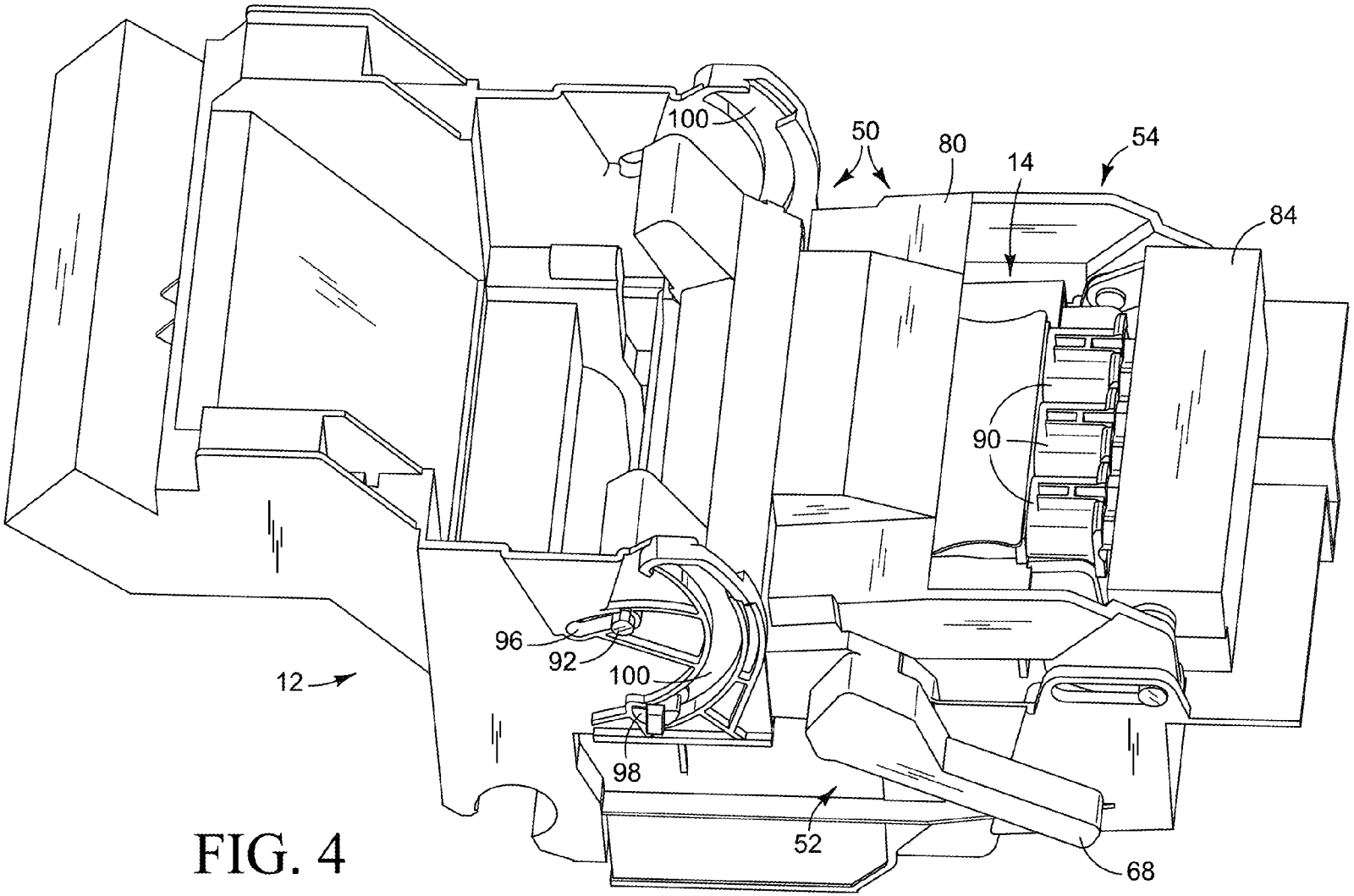

FIGS. 2-4 are perspective views illustrating one embodiment of a new latch 50 for securing a printhead module 14 in a printer carriage 12, for example in a printer 10 such as that shown in FIG. 1. In the embodiment of FIGS. 2-4, the module hold down and ink supply connecting functions are achieved using independent levers in a dual latching operation. Latch 50 is fully open in FIGS. 2 and 3. Latch 50 is fully closed in FIG. 4. Referring to FIGS. 2-4, latch 50 includes a first part 52 for holding printhead module 14 in the desired position seated in carriage 12 and a second part 54 for connecting printhead module 14 to ink supply ports 56, 58, 60, 62, 64, and 66 while first part 52 holds printhead module 14 in the seated position in carriage 12.

Figure 5:
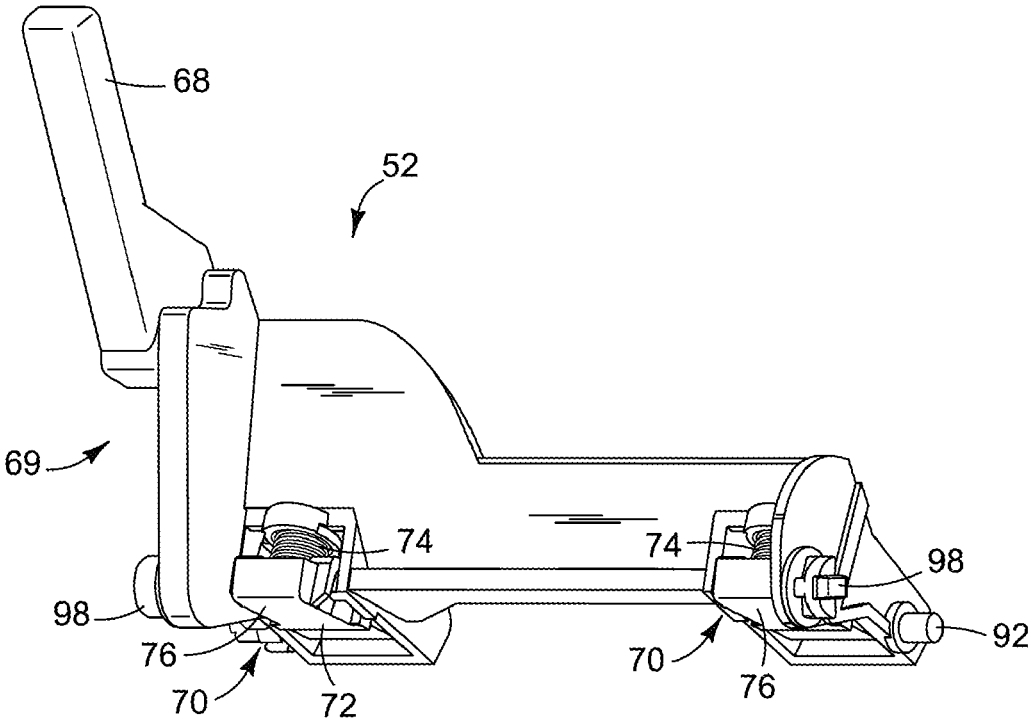
FIG. 5 is a detail view illustrating one part of the latch of FIGS. 2-4 for holding the printhead module.

FIG. 5 is a detail view illustrating latch part 52. Referring to FIGS. 2-5, latch part 52 includes a first lever arm 68 connected to a pair of contact assemblies 70 spaced apart on opposite sides of printhead module 14. Each contact assembly 70 includes a pivot arm 72, a biasing spring 74, and a contact surface 76 on arm 72 for engaging a corresponding contact surface 78 on printhead module 14.

Figure 6:
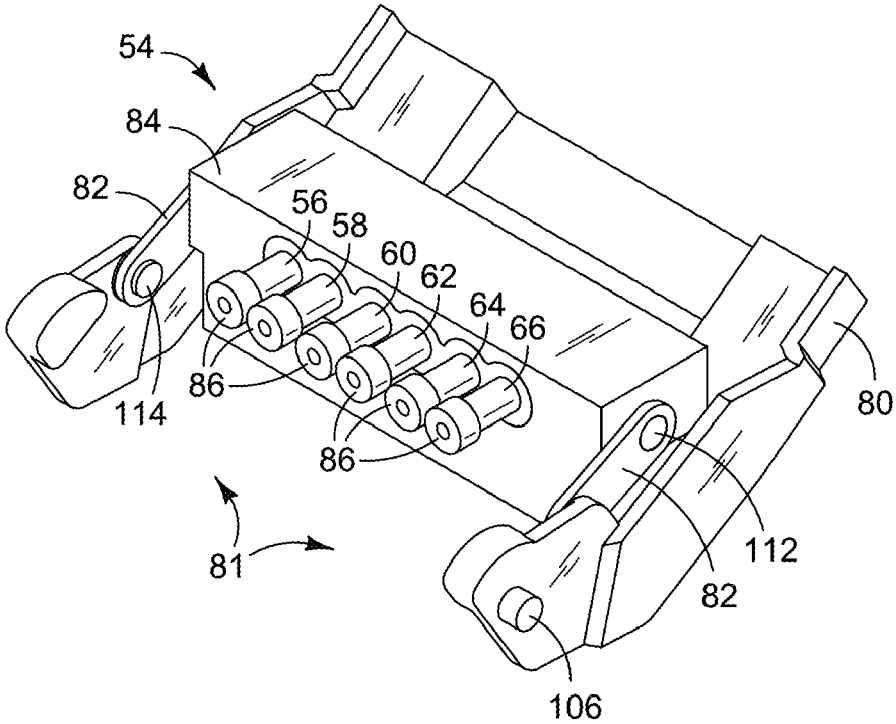
FIG. 6 is a detail view illustrating another part of the latch of FIGS. 2-4 for connecting the ink supply ports to the printhead module.

FIG. 6 is a detail view illustrating latch part 54. Referring to FIGS. 2-4 and 6, latch part 54 includes a second lever arm 80 operatively connected to ink supply ports 56-66 through a pair of connecting links 82 and a supply port mounting block 84. Mounting block 84 supports ink supply ports 56-66 to allow all six ports to move together as a unit for connecting to and disconnecting from printhead module 14. As best seen in FIG. 6, each ink supply port 56-66 includes a septum 86 facing a corresponding needle 88 (FIGS. 3 and 7) of printhead module 14. Needles 88 are protected by a shroud 90 along the top of printhead module 14.

The operation of latch 50 will now be described with reference to the elevation views of FIGS. 7-13. Different line types are used in FIGS. 7-13 to help distinguish between overlapping parts. Throughout the figures, direction arrows 87 indicate the motion of first lever arm 68, direction arrows 89 indicate the motion of second lever arm 80, and direction arrows 91 indicate the motion of ink supply port mounting block 84.

Figure 7:
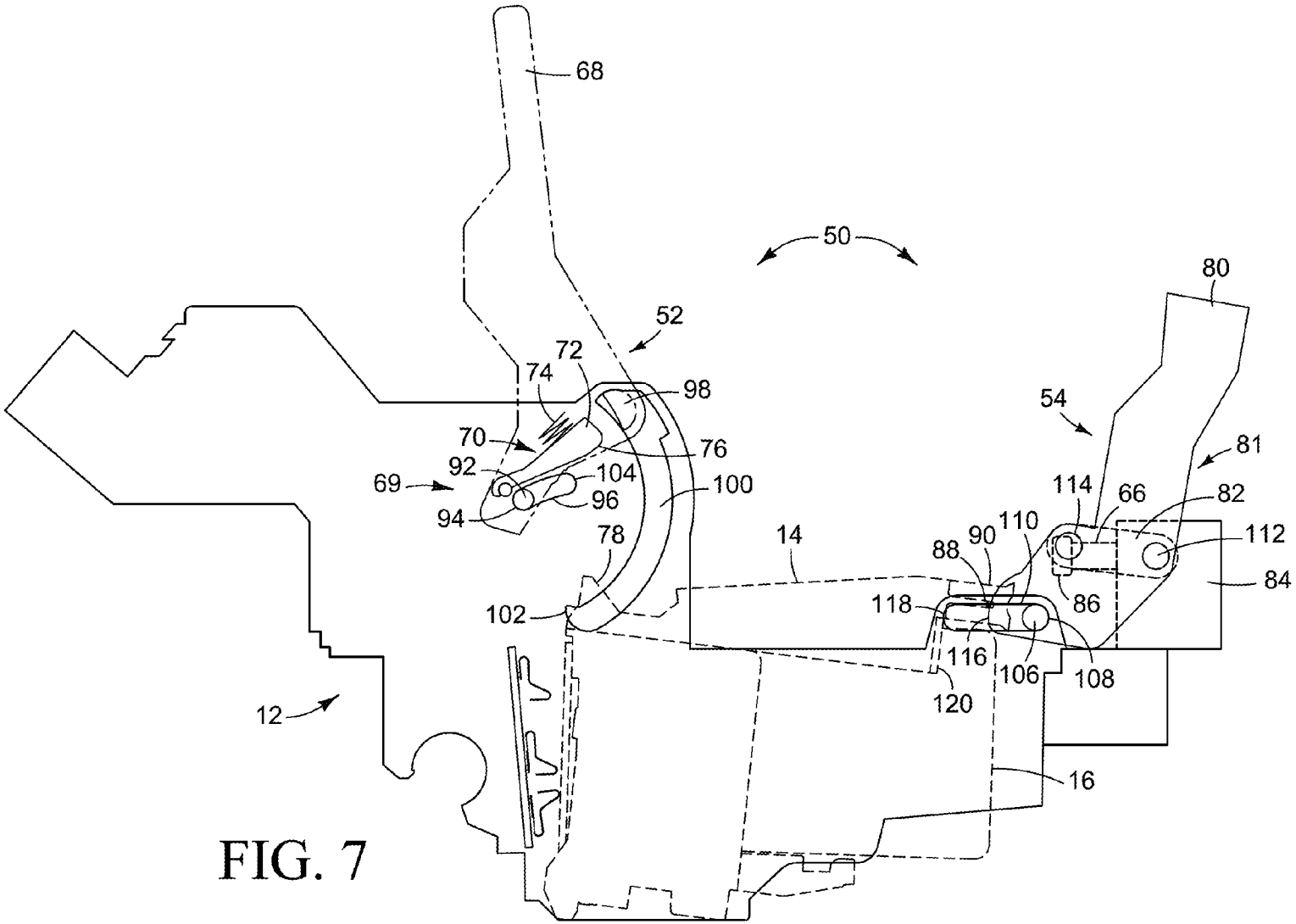
FIGS. 7-13 are elevation views illustrating a sequence of operation for the latch of FIGS. 2-4.
Figure 8:
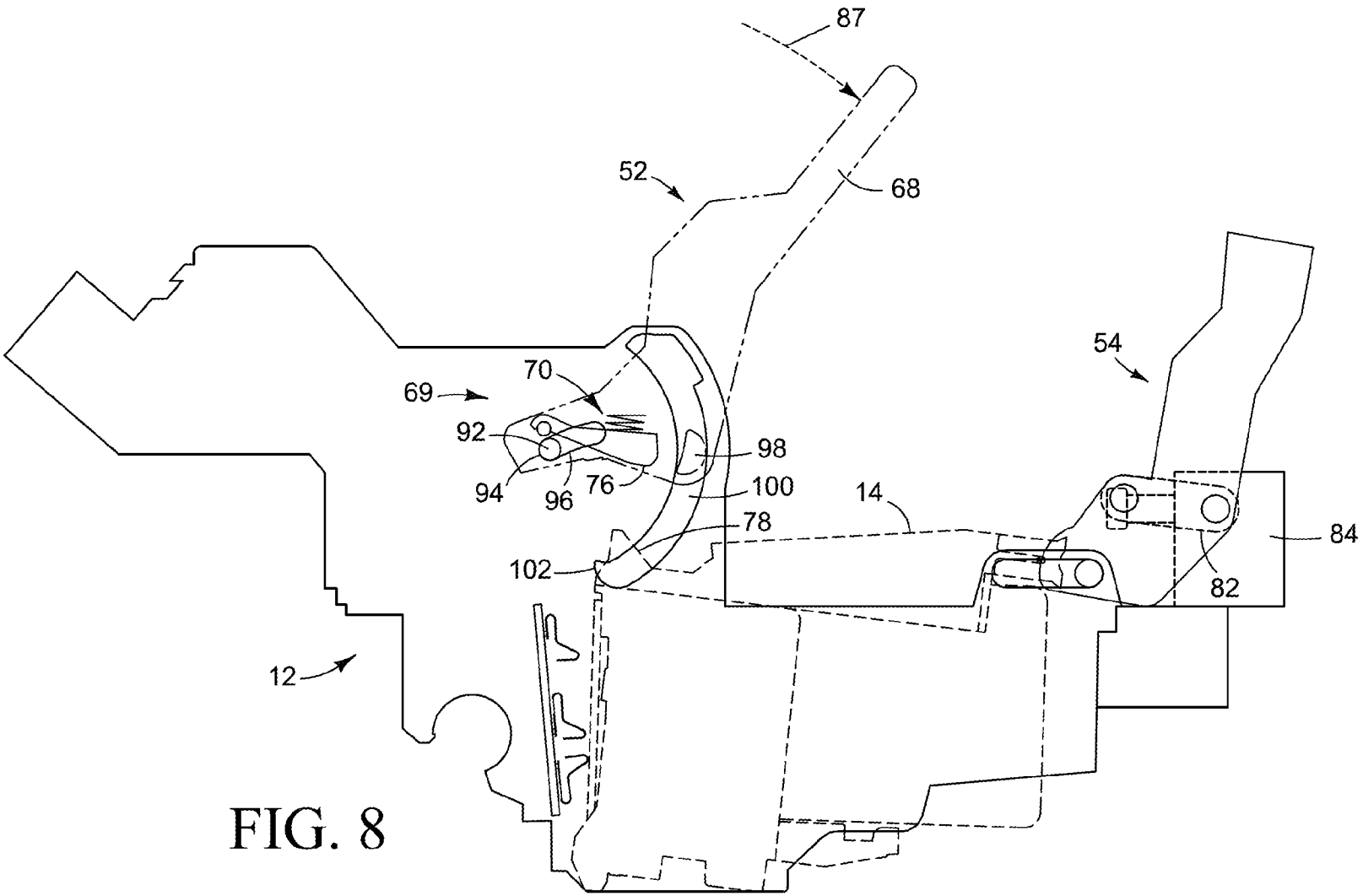

Referring first to FIG. 7, printhead module 14 has been placed in carriage 12 but latch 50 remains fully open. The placement of printhead module 14 and the position latch 50 in FIG. 7 corresponds to that shown in the perspective view of FIG. 2. Latch part 52 is operated first to hold printhead module 14 in the desired position during the subsequent operation of latch part 54. As best seen by comparing FIGS. 7, 8 and 9, each pivot arm 72 rotates down (clockwise) with first lever arm 68 through a first range of motion until contact surfaces 76 engage corresponding contact surfaces 78 on printhead module 14 to push printhead module 14 into the seated position, properly aligned in carriage 12. During this first part of the operation, first lever arm 68 pivots on a first pin 92 at a first location 94 in a first slot 96 in carriage 12. Also during this first part of the operation, the motion of first lever arm 68 is guided by a second pin 98 moving along a second slot 100 in carriage 12.

Figure 9:
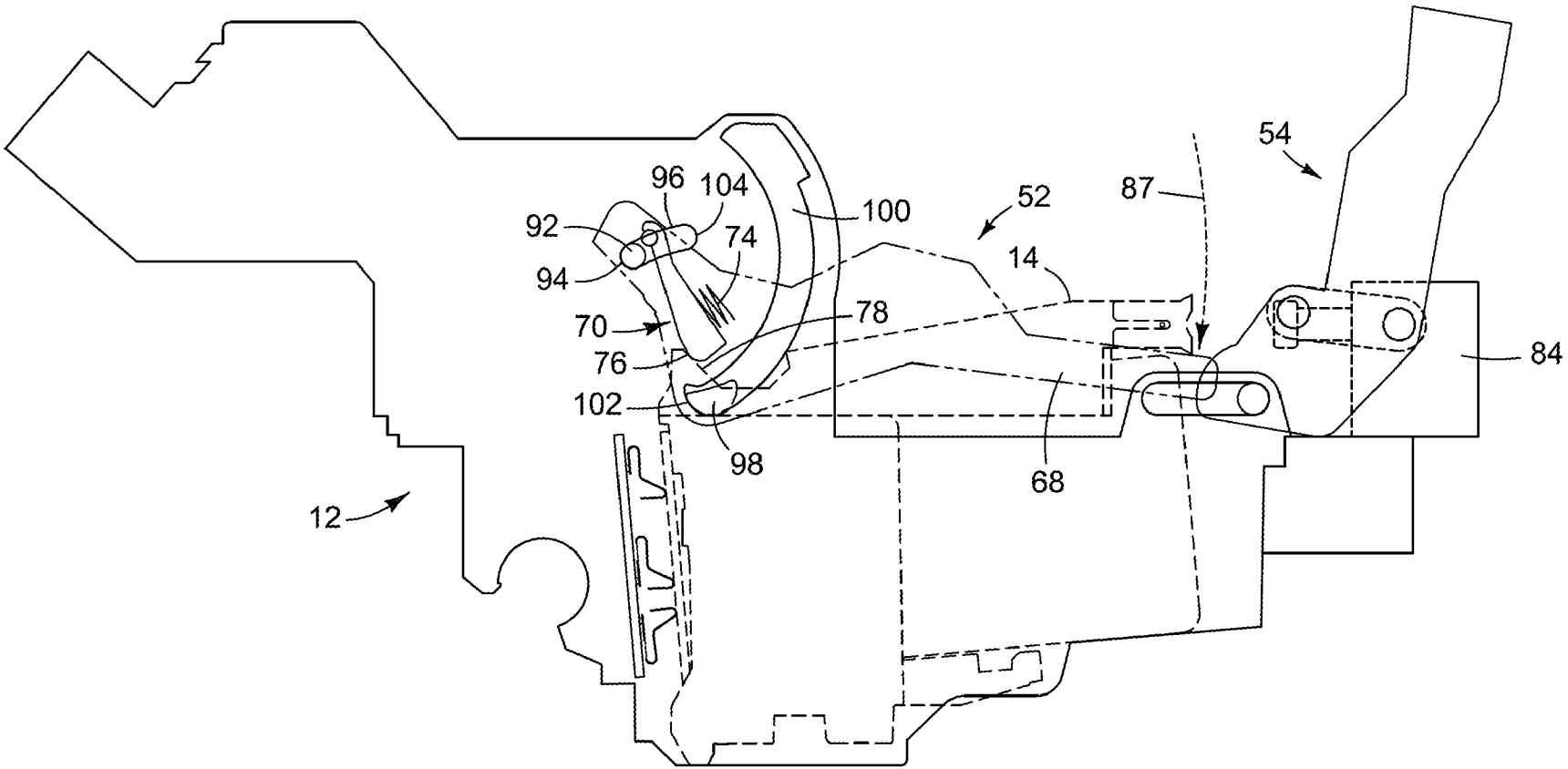
Figure 10:
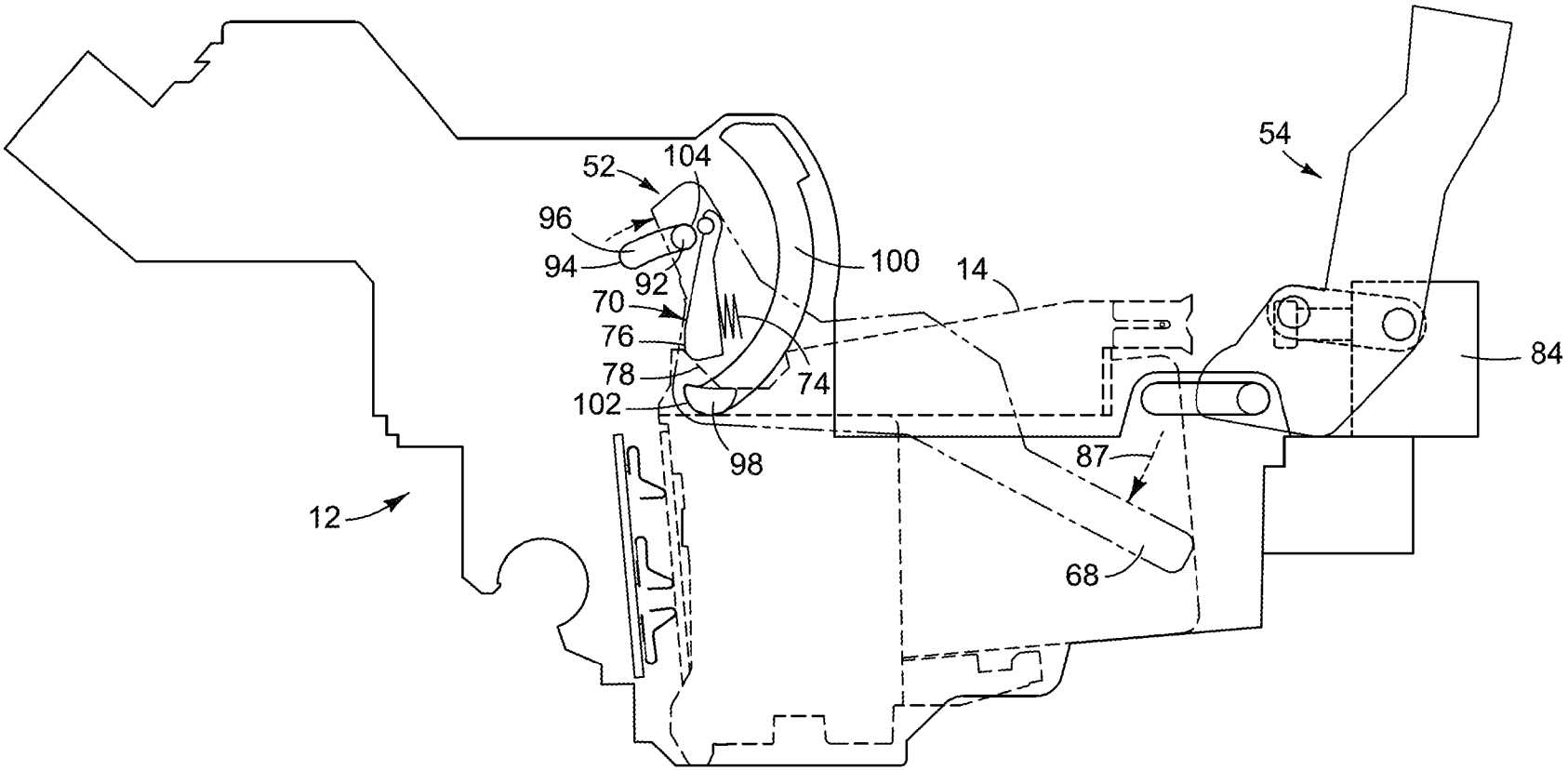

Then, as first lever arm 68 is pushed further down (clockwise), first lever arm 68 pivots on second pin 98 at a second location 102 in second slot 100 through a second range of motion, as best seen by comparing FIGS. 9 and 10. Accordingly, pivot arm 72 pivots at contact surface 76, compressing spring 74 to maintain pressure on printhead module 14 in the seated position in carriage 12 and to help retain latch part 52 in the fully closed position shown in FIG. 10—the contact force on first lever arm 68 at surface 76 is offset from second pin 98 to exert a torque on lever arm 68 toward the closed position. During this part of the operation, motion of first lever arm 68 and arm 72 is guided by first pin 92 moving along slot 96 from first location 94 to a third location 104.

First lever arm 68 pivoting on first pin 92 through the first range of motion and then pivoting on second pin 98 through the second range of motion forms a first lever 69 for actuating first latch part 52 to move from the fully open position shown in FIG. 7 to the partially closed position shown in FIG. 9 and then to the fully closed position shown in FIG. 10.

With latch part 52 closed and printhead module 14 seated, as shown in FIG. 10, each septum 86 on a corresponding ink supply port 56-66 is aligned with needle 88. Latch part 54 may then be operated to connect printhead module 14 to ink ports 56-66 as described below with reference to FIGS. 10-13. Detail views FIGS. 11A, 11B, 12A, 12B, and 13A, 13B are provided for clarity. Block 84 and supply ports 56-66 are omitted in FIGS. 11A, 12A, and 13A to better illustrate the latch parts. Some of the latch parts are omitted in FIGS. 11B, 12B, and 13B to better illustrate the movement of supply ports 56-66.

As best seen by comparing FIGS. 10, 11 and 12, second lever arm 80 is rotated down (counterclockwise) to move block 84 carrying ink supply ports 56-66 toward needles 88. During this part of the operation, second lever arm 80 pivots on a third pin 106 at a fourth location 108 in a third slot 110 in carriage 12. Connecting link 82 pivots on a fourth pin 112 on block 84 and a fifth pin 114 on second lever arm 80. Thus, connecting link 82 converts the rotating motion of second lever arm 80 into a linear motion of block 84 carrying supply ports 56-66. As shown in FIG. 12, when latch part 54 is fully closed each needle 88 pierces the corresponding supply port septum 86 to make the ink connections to printhead module 14 through supply ports 56-66.

Printhead module 14 is disconnected from ink supply ports 56-66 by opening latch part 54. It is desirable to keep needles 88 and ink supply ports 56-66 aligned as needles 88 are withdrawn from supply ports 56-66 to minimize the necessary withdrawal force and, accordingly, to lower the risk of damaging needles 88 or septa 86. Application of the withdrawal force tends to unseat printhead module 14 and misalign needles 88 in supply ports 56-66. Thus, as best seen by comparing FIGS. 12 and 13, latch part 54 includes a blocking surface 116 that is extended to block printhead module 14 during disengagement, keeping printhead module 14 seated in carriage 12 and needles 88 correctly aligned with supply ports 56-66. As second lever arm 80 moves up (clockwise) in FIG. 13, the friction of the withdrawing septa 86 on needles 88 causes third pivot pin 106 to slide toward the front of third slot 110 at a fifth location 118 and bring blocking surface 116 into contact with printhead module 14. This contact area is designated by part number 120 in FIG. 13. Printhead module 14 becomes a temporary fulcrum for second lever arm 80 (bearing against printhead module 14 at contact area 120), simultaneously giving mechanical advantage to the disconnect force and blocking printhead module 14 from being unseated by that force.

Once septa 86 are disconnected from needles 88, a biasing spring (not shown) may be used to return third pivot pin 106 to the rear of third slot 110 at fourth location 108 shown in FIG. 10, or pin 106 may be allowed to return to fourth location 108 at the urging of the continued rotation of lever arm 80 as latch part 54 is moved to the fully open position (FIG. 10) or as lever arm 80 is moved down in the next operation to close part 54 and reconnect printhead module 14 to ink supply ports 56-66.

Second lever arm 80 pivoting on third pin 106 forms a second lever 81 for actuating second latch part 54 to move between the fully open position shown in FIG. 10 to the fully closed position shown in FIG. 12.

Single Latching Embodiment

FIGS. 14-16 are perspective views illustrating another embodiment of a latch 50 for securing printhead module 14 in a printer carriage 12. Latch 50 is fully open in FIGS. 14 and 15. Latch 50 is fully closed in FIG. 16. In this embodiment of latch 50, the hold down and engagement functions are achieved using one actuator in a single latching operation.

Referring to FIGS. 14-16, latch 50 includes a first part 52 for holding printhead module 14 in the desired position seated in carriage 12 and a second part 54 for connecting printhead module 14 to ink supply ports 56, 58, 60, 62, 64, and 66 while first part 52 holds printhead module 14 in the desired position in carriage 12. A single actuator 122 synchronizes the movement of each latch part 52, 54 for opening and closing latch 50.

FIG. 17 is a detail view illustrating latch first part 52 and actuator 122. Referring to FIGS. 14-17, latch part 52 includes a first lever arm 68 connected to a pair of contact assemblies 70 spaced apart on opposite sides of printhead module 14. Each contact assembly 70 includes a pivot arm 72, a biasing spring 74, and a contact surface 76 on arm 72 for engaging a corresponding contact surface 78 (FIG. 14) on printhead module 14.

FIG. 18 is a detail view illustrating latch second part 54. Referring to FIGS. 14-16 and 18, latch part 54 includes a second lever arm 80 operatively connected to ink supply ports 56-66 through a pair of connecting links 82 and a supply port mounting block 84. Each ink supply port 56-66 includes a septum 86 facing a corresponding needle 88 (FIGS. 15 and 19) of printhead module 14. Needles 88 are protected by a shroud 90 along the top of printhead module 14. Second lever arm 80 includes a bail 124 for connecting to actuator 122. Actuator 122 includes a third lever arm 126 operatively connected to latch first part 52 at sixth pivot pins 128. Actuator lever arm 126 is connectable to latch second part 54 at bail 124 through a hook 130. Actuator lever arm 126 includes a handle 132 for the user to grasp while operating actuator 122.

The operation of this embodiment of latch 50 will now be described with reference to FIGS. 19-25. Detail views FIGS. 22A, 22B, 23A, and 23B are provided for clarity. Different line types are used in the elevation views of FIGS. 19-23 to help distinguish between overlapping parts. Direction arrows 131 indicate the motion of actuator lever arm 126 in FIGS. 19 and 21-23.

Figure 19:
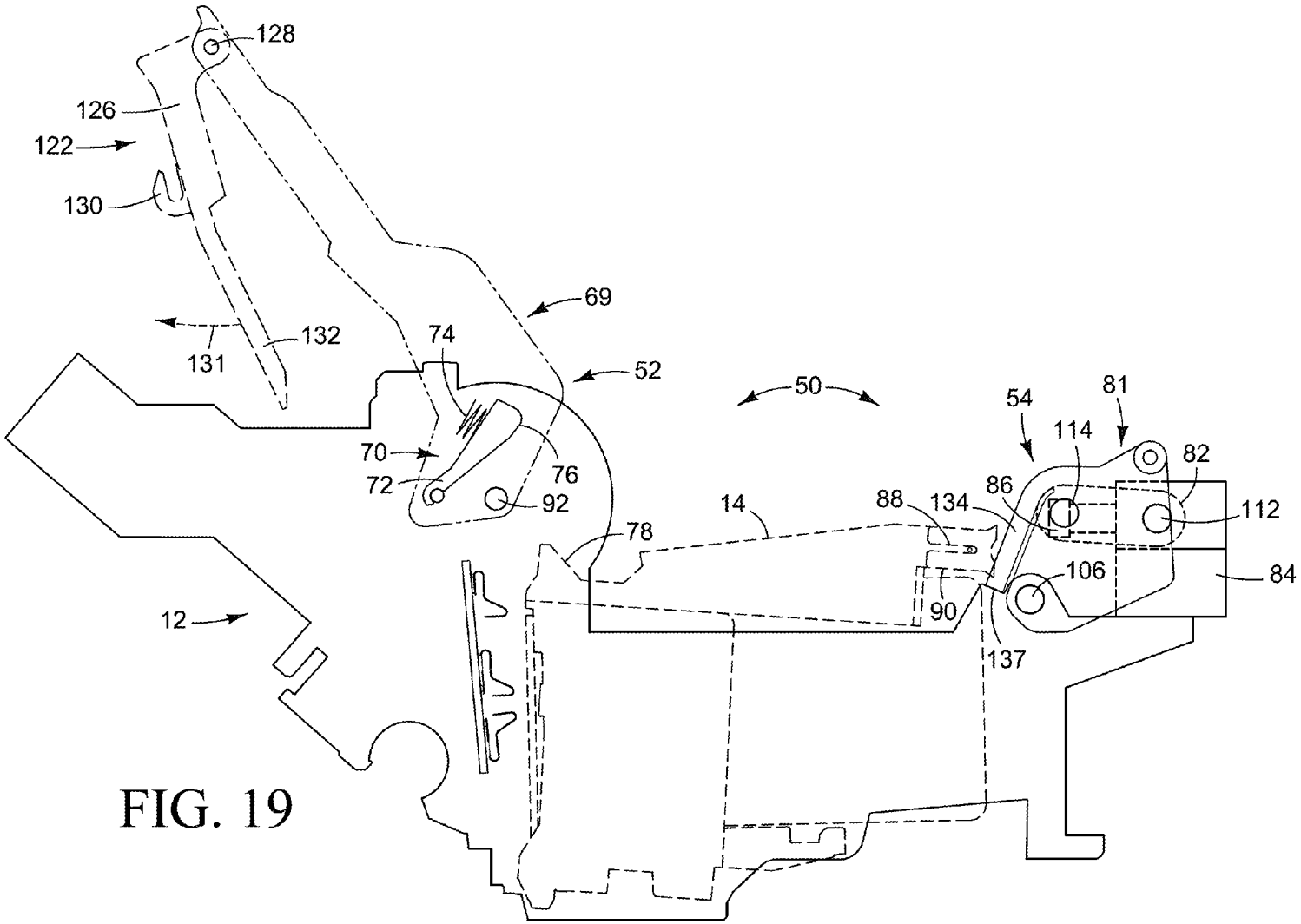

Referring to FIGS. 19-21, the user grasps handle 132 on actuator 122 to rotate first lever arm 68 clockwise to close latch first part 52. First lever arm 68 pivots on first pins 92 mounted to carriage 12. As best seen by comparing FIGS. 20 and 21, each pivot arm 72 rotates down (clockwise) with first lever arm 68 until contact surfaces 76 engage corresponding contact surfaces 78 on printhead module 14.

Actuator handle 132 pivots on sixth pins 128 to align hook 130 to bail 124 on latch second part 54 as shown in FIG. 21. Latch second part 54 may then be closed at the urging of actuator 122 to first put printhead module 14 into the proper, datum position in carriage 12 (compare FIGS. 20 and 21) and then to connect printhead module 14 to ink ports 56-66 (compare FIGS. 22 and 23). As best seen by comparing the sequence of FIGS. 21, 22, and 23, once actuator 122 is hooked to bail 124, actuator (third) lever arm 126 pivots on fulcrum pins 128 as handle 132 is rotated counterclockwise. Actuator lever arm 126, in turn, rotates second lever arm 80 counterclockwise and moves block 84 carrying ink supply ports 56-66 toward needles 88. During this part of the operation, second lever arm 80 pivots on third pin 106 mounted to carriage 12. Connecting link 82 pivots on fourth pin 112 on block 84 and fifth pin 114 on second lever arm 80. Thus, connecting link 82 converts the rotating motion of second lever arm 80 into a linear motion of block 84 carrying supply ports 56-66. As shown in FIG. 23, when latch part 54 is fully closed each needle 88 pierces the corresponding supply port septum 86 to make the ink connections to printhead module 14 through supply ports 56-66.

In this embodiment of latch 50, latch second part 54 includes a lock 134 that blocks the unintended or inadvertent operation of latch second part 54. As best seen in FIG. 18, lock 134 is constructed as a pair of spring tabs 134 positioned on opposite sides of mounting block 84. A key 136 on actuator 122 unlocks lock 134 as actuator 122 is rotated counterclockwise to begin closing latch second part 54. As best seen by comparing the elevation views of FIGS. 21-23 and the section views of FIGS. 24 and 25, keys 136 push tabs 134 inboard, off the corresponding stops 137 on carriage 12, to allow second lever arm 80 to pivot, thus unlocking latch second part 54.

Also in this embodiment of latch 50, first lever arm 68 is "over-rotated" to compress biasing spring 74 and exert added pressure on printhead module 14 as septa 86 are pushed on to and pulled off of needles 88. This added pressure helps keep printhead module 14 seated and stationary during the time when maximum force is exerted making and breaking the ink supply connections. As best seen by comparing FIGS. 21 and 22, as actuator lever arm 126 is rotated counterclockwise to close latch second part 54, it drives the distal end 138 of first lever arm 68 down just as septa 86 reach needles 88. This clockwise rotation of first lever arm 68 rotates pivot arm 72 clockwise to drive contact surface 76 into printhead module 14 (at contact surface 78) and compress biasing spring 74. Then, as actuator lever arm 126 continues to rotate to the fully closed position for latch part 54 (where needles 88 have pierced septa 86), shown in FIG. 23, it pulls the end 138 of first lever arm 68 up to release the added pressure. In the same way, added pressure is exerted as actuator lever 126 is rotated up (clockwise) to open latch second part 54 and withdraw septa 86 from needles 88.

As noted at the beginning of this Description, the embodiments shown in the figures and described above illustrate but do not limit the invention. Other embodiments are possible. Therefore, the foregoing description should not be construed to limit the scope of the invention, which is defined in the following claims.

What is claimed is:

1. A latch for a liquid dispensing component, comprising:

a first part for holding the component in a seated position in a holder, the first part movable between an open position in which the component may be installed in or removed from the holder and a closed position in which the component is held stationary in the seated position in the holder;

a second part for connecting the component to a liquid supply port, the second part movable, while the first part is in the closed position, between a disconnected position in which the component is not connected to the liquid supply port and a connected position in which the component is connected to the liquid supply port; and an actuator connectable between the first part and the second part to, in a single latching operation, synchronize movement of the first part to the closed position with movement of the second part to the connected position while the first part is in the closed position.

2. The latch of claim 1, where:

the first part comprises a first lever connected to a surface for holding the component in the seated position when the first part is in the closed position;

the second part comprises a second lever and a link between the second lever and the liquid supply port for connecting the liquid supply port to the component and disconnecting the liquid supply port from the component; and the actuator comprises a third lever affixed to the first lever at a fulcrum and detachably connected to the second lever at a load for moving the second lever from the disconnected position to the connected position.

3. A latch for securing an ink cartridge in an inkjet printer carriage, the latch comprising:

a first part for holding the cartridge in a seated position in the carriage, the first part movable between an open position in which the cartridge may be installed in or removed from the carriage and a closed position in which the cartridge is held stationary in the seated position in the carriage;

a second part for connecting the cartridge to an ink supply port, the second part movable, while the first part is in the closed position, between a disconnected position in which the cartridge is not connected to the ink supply port and a connected position in which the cartridge is connected to the ink supply port; and an actuator detachably connected between the first part and the second part and configured to synchronize movement of the first part to the closed position with movement of the second part to the connected position while the first part is in the closed position.

4. The latch of claim 3, where the actuator is configured to, in a single latching operation, move the first part into the closed position and move the second part to the connected position while the first part is in the closed position.

5. The latch of claim 4, where:

the first part comprises a first lever connected to a surface for holding the component in the seated position when the first part is in the closed position;

the second part comprises a second lever and a link between the second lever and the liquid supply port for connecting the liquid supply port to the component and for disconnecting the liquid supply port from the component; and the actuator comprises a third lever affixed to the first lever at a fulcrum and detachably connected to the second lever at a load for moving the second lever from the disconnected position to the connected position.

6. The latch of claim 3, where the ink cartridge comprises:

a printhead; and multiple ink flow regulators operatively connected to the printhead in a single module.

7. The latch of claim 3, where:

the ink cartridge comprises multiple ink cartridges;

the ink supply port comprises multiple ink supply ports; and the cartridges and the supply ports are arranged with respect to one another such that all of the cartridges are connected simultaneously to the corresponding ports.

8. The latch of claim 7, where the ink cartridges are part of a printhead module having a printhead operatively connected to each of the cartridges.

9. A carriage for carrying an ink cartridge, comprising:

a body having a bay therein for holding the ink cartridge;

multiple ink supply ports near the bay;

a first lever operatively connected between the body and a contact surface, the first lever movable between an open position in which the ink cartridge may be installed in or removed from the bay and a closed position in which the contact surface contacts the ink cartridge to hold the ink cartridge stationary in a seated position in the bay;

a second lever operatively connected between the body and the ink supply ports, the second lever movable between a disconnected position in which the ink supply ports are not connected to the ink cartridge and a connected position in which the ink supply ports are connected to the ink cartridge; and a third lever detachably connected between the first lever and the second lever to synchronize moving the second lever from the disconnected position to the connected position while the first lever is in the closed position and to synchronize moving the second lever from the connected position to the disconnected position while the first lever is in the closed position.

10. The carriage of claim 9, where the third lever is affixed to the first lever at a fulcrum and detachably connected to the second lever at a load for moving the second lever from the disconnected position to the connected position while the first lever is in the closed position and for moving the second lever from the connected position to the disconnected position while the first lever is in the closed position.

11. The carriage of claim 9, further comprising a connecting link between the second lever and the ink supply ports, the connecting link configured to convert rotating motion of the second lever into linear motion of the ink supply ports for connecting the ink supply ports to the ink cartridge and disconnecting the ink supply ports from the ink cartridge.

12. The carriage of claim 9, further comprising a lock operable between a locked position blocking movement of the ink supply ports when the third lever is not connected to the second lever and an unlocked position not blocking movement of the ink supply ports when the third lever is connected to the second lever and moving the second lever toward the disconnected position.

13. The carriage of claim 9, further comprising a biasing spring operatively connected between the first lever and the contact surface for biasing the contact surface against the ink cartridge when the first lever is in the closed position, and where the third lever is configured to rotate the first lever to compress the biasing spring as the third lever moves the second lever from the connected position toward the disconnected position.

* * * * *